US009998845B2

(12) United States Patent
Shi et al.

(10) Patent No.: US 9,998,845 B2
(45) Date of Patent: Jun. 12, 2018

(54) INFORMATION PROCESSING DEVICE AND METHOD, AND PROGRAM

(71) Applicant: Sony Corporation, Tokyo (JP)

(72) Inventors: Runyu Shi, Tokyo (JP); Toru Chinen, Kanagawa (JP); Yuki Yamamoto, Tokyo (JP); Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days. days.

(21) Appl. No.: 14/905,116

(22) PCT Filed: Jul. 11, 2014

(86) PCT No.: PCT/JP2014/068544
§ 371 (c)(1),
(2) Date: Jan. 14, 2016

(87) PCT Pub. No.: WO2015/012122
PCT Pub. Date: Jan. 29, 2015

(65) Prior Publication Data

US 2016/0165374 A1 Jun. 9, 2016

(30) Foreign Application Priority Data

Jul. 24, 2013 (JP) ..... 2013-153736
Oct. 9, 2013 (JP) ..... 2013-211643

(51) Int. Cl.
*H04S 7/00* (2006.01)
*H04S 5/00* (2006.01)

(52) U.S. Cl.
CPC ..... *H04S 7/303* (2013.01); *H04S 5/005* (2013.01); *H04S 2400/11* (2013.01); *H04S 2400/13* (2013.01); *H04S 2400/15* (2013.01)

(58) Field of Classification Search
None
See application file for complete search history.

(56) References Cited

U.S. PATENT DOCUMENTS 5,751,815 A * 5/1998 Philp ..... H04S 1/007 381/17
8,204,615 B2 6/2012 Yamada et al.
(Continued)

FOREIGN PATENT DOCUMENTS

JP 2008-017117 A 1/2008
WO WO 2007/083739 A1 7/2007

OTHER PUBLICATIONS

Pulkki V., Virtual Sound Source Positioning Using Vector Base Amplitude Planning, J. Audio Eng. Soc., vol. 45, No. 6, Jun. 1997, 456-466.

*Primary Examiner* — Curtis Kuntz
*Assistant Examiner* — Kenny Truong
(74) *Attorney, Agent, or Firm* — Wolf, Greenfield & Sacks, P.C.

(57) ABSTRACT

The present technology relates to an information processing device and method for allowing a sound image to be localized with higher precision, and a program. When a target sound image is outside a mesh, the target sound image is moved in a vertical direction while a position in a horizontal direction of the target sound image remains fixed, so that the target sound image is present on a boundary of the mesh. Specifically, a mesh detection unit detects a mesh including a position in the horizontal direction of the target sound image. A candidate position calculation unit calculates a position that is a movement target of the target sound image, based on loudspeaker positions that are at opposite ends of an arc of the detected mesh that is a destination, and the position in the horizontal direction of the target sound image. As a result, the target sound image can be moved onto a boundary of the mesh. The present technology is applicable to a sound processing device.

17 Claims, 26 Drawing Sheets

(56) References Cited

U.S. PATENT DOCUMENTS

| | | | | |
|---|---|---|---|---|
| 8,472,653 | B2 | 6/2013 | Kon | |
| 8,503,682 | B2 | 8/2013 | Fukui et al. | |
| 8,520,857 | B2 | 8/2013 | Fukui et al. | |
| 8,831,231 | B2 | 9/2014 | Fukui et al. | |
| 8,873,761 | B2 | 10/2014 | Fukui et al. | |
| 2009/0043411 | A1 | 2/2009 | Yamada et al. | |
| 2009/0208022 | A1 | 8/2009 | Fukui et al. | |
| 2009/0214045 | A1 | 8/2009 | Fukui et al. | |
| 2010/0053210 | A1 | 3/2010 | Kon | |
| 2010/0157726 | A1 | 6/2010 | Ando et al. | |
| 2010/0322428 | A1 | 12/2010 | Fukui et al. | |
| 2011/0286601 | A1 | 11/2011 | Fukui et al. | |
| 2011/0305358 | A1 | 12/2011 | Nishio et al. | |
| 2013/0287235 | A1 | 10/2013 | Fukui et al. | |
| 2014/0205111 | A1 | 7/2014 | Hatanaka et al. | |
| 2014/0219456 | A1* | 8/2014 | Morrell | H04S 5/00 381/17 |
| 2015/0146873 | A1* | 5/2015 | Chabanne | H04S 3/008 381/1 |
| 2016/0073213 | A1 | 3/2016 | Yamamoto et al. | |
| 2016/0080883 | A1 | 3/2016 | Yamamoto et al. | |

* cited by examiner

FIG. 15

```
if γnD > γnD_max {
    if γ > γnD_max {
        if |γ − γnD_max| < |γ − γnD| {
            γ = γnD_max
        }
        else {
            γ = γnD
        }
    }
    elseif γ < γnD_min {
        γ = γnD_min
    }
}
elseif γnD < γnD_min {
    if γ < γnD_min {
        if |γ − γnD_min| < |γ − γnD| {
            γ = γnD_min
        }
        else {
            γ = γnD
        }
    }
    elseif γ > γnD_max {
        γ = γnD_max
    }
}
else {
    PROCESS 3D(6)
}
```

INFORMATION PROCESSING DEVICE AND METHOD, AND PROGRAM

TECHNICAL FIELD

The present technology relates to information processing devices and methods, and programs, and more particularly, to an information processing device and method for allowing a sound image to be localized with higher precision, and a program.

BACKGROUND ART

In the background art, vector base amplitude pannning (VBAP) is known as a technique of controlling the localization of a sound image using a plurality of loudspeakers (see, for example, Non-Patent Literature 1).

In VBAP, a target position where a sound image is to be localized is represented by a linear combination of vectors pointing to two or three loudspeakers placed around the target position. Also, gain adjustment is performed so that a sound image is to be localized at the target position, where coefficients multiplied by the respective vectors in the linear combination are used as the gains of sound signals output from the respective loudspeakers.

CITATION LIST

Non-Patent Literature

Non-Patent Literature 1: Ville Pulkki, "Virtual Sound Source Positioning Using Vector Base Amplitude Panning," Journal of AES, vol. 45, no. 6, pp. 456-466, 1997

SUMMARY OF INVENTION

Technical Problem

However, in some cases, the above technique cannot achieve high-precision localization of a sound image.

Specifically, VBAP cannot allow for localization of a sound image at a position outside a mesh surrounded by loudspeakers placed on a spherical surface or an arc. Therefore, when a sound image is reproduced outside the mesh, it is necessary to move the position of the sound image into the range of the mesh. However, the above technique has difficulty in moving a sound image to an appropriate position within the mesh.

With such circumstances in mind, the present technology has been made to allow for higher-precision localization of a sound image.

Solution to Problem

According to an aspect of the present technology, there is provided an information processing device including: a detection unit configured to detect at least one mesh including a horizontal direction position of a target sound image in a horizontal direction, of meshes that are a region surrounded by a plurality of loudspeakers, and specify at least one mesh boundary that is a movement target of the target sound image in the mesh; and a calculation unit configured to calculate a movement position of the target sound image on the specified at least one mesh boundary that is the movement target, based on positions of two of the loudspeakers present on the specified at least one mesh boundary that is the movement target, and the horizontal direction position of the target sound image.

The movement position may be a position on the boundary having a same position as the horizontal direction position of the target sound image in the horizontal direction.

The detection unit may detect the mesh including the horizontal direction position of the target sound image in the horizontal direction, based on positions in the horizontal direction of the loudspeakers forming the mesh, and the horizontal direction position of the target sound image.

The information processing device may further includes a determination unit configured to determine whether or not it is necessary to move the target sound image, based on at least either of a position relationship between the loudspeakers forming the mesh, or positions in a vertical direction of the target sound image and the movement position.

The information processing may further includes a gain calculation unit configured to, when it is determined that it is necessary to move the target sound image, calculate a gain of a sound signal of sound, based on the movement position, and positions of the loudspeakers of the mesh, in a manner that a sound image of the sound is to be localized at the movement position.

The gain calculation unit may adjust the gain based on a difference between a position of the target sound image and the movement position.

The gain calculation unit may further adjust the gain based on a distance from the position of the target sound image to a user, and a distance from the movement position to the user.

The information processing device may further includes a gain calculation unit configured to, when it is determined that it is not necessary to move the target sound image, calculate a gain of a sound signal of sound, based on a position of the target sound image and positions of the loudspeakers of the mesh, in a manner that a sound image of the sound is to be localized at the position of the target sound image, the mesh including the horizontal direction position of the target sound image in the horizontal direction.

The determination unit may determine that it is necessary to move the target sound image, when a highest position in the vertical direction of the movement positions calculated for the meshes is lower than a position of the target sound image.

The determination unit may determine that it is necessary to move the target sound image, when a lowest position in the vertical direction of the movement positions calculated for the meshes is higher than a position of the target sound image.

The determination unit may determine that it is not necessary to move the target sound image downward, when the loudspeaker is present at a highest possible position in the vertical direction.

The determination unit may determine that it is not necessary to move the target sound image upward, when the loudspeaker is present at a lowest possible position in the vertical direction.

The determination unit may determine that it is not necessary to move the target sound image downward, when there is the mesh including a highest possible position in the vertical direction.

The determination unit may determine that it is not necessary to move the target sound image upward, when there is the mesh including a lowest possible position in the vertical direction.

The calculation unit may calculate and record a maximum value and a minimum value of the movement position for each of the horizontal direction positions in advance. The information processing device may further include a determination unit configured to calculate a final version of the movement position of the target sound image based on the recorded maximum value and minimum value of the movement position, and a position of the target sound image.

According to an aspect of the present technology, there is provided an information processing method or program including the steps of: detecting at least one mesh including a horizontal direction position of a target sound image in a horizontal direction, of meshes that are a region surrounded by a plurality of loudspeakers, and specifying at least one mesh boundary that is a movement target of the target sound image in the mesh; and calculating a movement position of the target sound image on the specified at least one mesh boundary that is the movement target, based on positions of two of the loudspeakers present on the specified at least one mesh boundary that is the movement target, and the horizontal direction position of the target sound image.

According to an aspect of the present technology, at least one mesh including a horizontal direction position of a target sound image in a horizontal direction, of meshes that are a region surrounded by a plurality of loudspeakers is detected, and at least one mesh boundary that is a movement target of the target sound image in the mesh is specified; and a movement position of the target sound image on the specified at least one mesh boundary that is the movement target is calculated based on positions of two of the loudspeakers present on the specified at least one mesh boundary that is the movement target, and the horizontal direction position of the target sound image.

Advantageous Effects of Invention

According to an aspect of the present technology, a sound image can be localized with higher precision.

BRIEF DESCRIPTION OF DRAWINGS

FIG. 15 is a diagram for describing determination of whether or not it is necessary to move a sound image, and calculation of a movement destination position.

DESCRIPTION OF EMBODIMENTS

Figure 1:
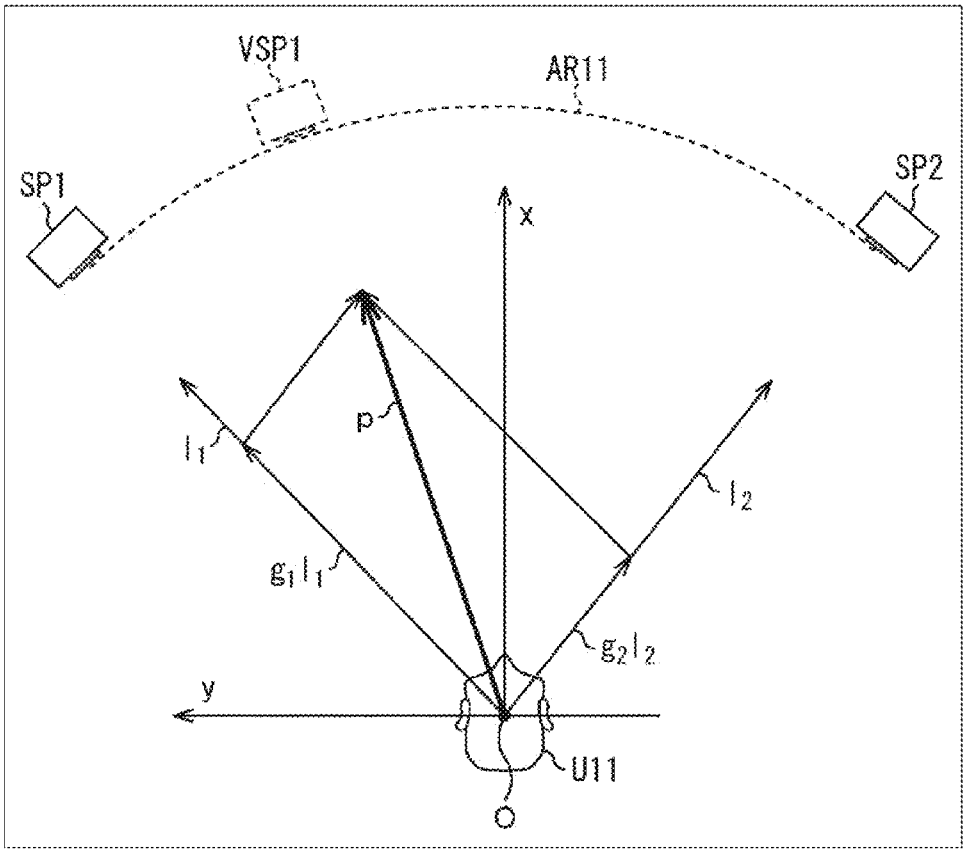
FIG. 1 is a diagram for describing two-dimensional VBAP.

Embodiments to which the present technology is applied will now be described with reference to the drawings.

First Embodiment

<Overview of the Present Technology>

Firstly, an overview of the present technology will be provided with reference to FIG. 1 to FIG. 5. Note that, in FIG. 1 to FIG. 5, parts corresponding to each other are indicated by the same reference characters and will not be redundantly described.

For example, as shown in FIG. 1, it is assumed that a user U11 who views and listens to contents, such as videos with sound, songs, and the like, is listening to two-channel sound output from two loudspeakers SP1 and SP2, as the sound of the contents.

In such a case, position information of the two loudspeakers SP1 and SP2, which output respective channel sounds, is used so that a sound image is to be localized at a sound image position VSP1, which will be discussed.

For example, the sound image position VSP1 is represented by a vector p originating from an origin O in a two-dimensional coordinate system where the origin O is the position of the head of the user U11, and the vertical direction is an x-axis direction and the horizontal direction is a y-axis direction in the drawing.

The vector p is a two-dimensional vector. Therefore, the vector p can be represented by a linear combination of a vector $l_1$ and a vector $l_2$ that originate from the origin O and point to the positions of the loudspeaker SP1 and the loudspeaker SP2, respectively. Specifically, the vector p can be represented by the following formula (1) using the vector $l_1$ and the vector $l_2$.

[Math 1]

$$p=g_1l_1+g_2l_2 \tag{1}$$

In Formula (1), if a coefficient $g_1$ and a coefficient $g_2$ that are multiplied by the vector $l_1$ and the vector $l_2$ are calculated, and the coefficient $g_1$ and the coefficient $g_2$ are used as gains for respective output sounds of the loudspeaker SP1 and loudspeaker SP2, a sound image can be localized at the sound image position VSP1. In other words, a sound image can be localized at a position indicated by the vector p.

Such a technique of controlling a position where a sound image is to be localized, by calculating the coefficient $g_1$ and the coefficient $g_2$ using the position information of the two loudspeakers SP1 and SP2, is called two-dimensional VBAP.

In the example of FIG. 1, a sound image can be localized at any position on an arc AR11 connecting the loudspeaker SP1 and the loudspeaker SP2. Here, the arc AR11 is a portion of a circle that has its center at the origin O and passes through the positions of the loudspeaker SP1 and the loudspeaker SP2. Such an arc AR11 is a mesh (hereinafter also referred to a two-dimensional mesh) in two-dimensional VBAP.

Note that the vector p is a two-dimensional vector, and therefore, if an angle between the vector $l_1$ and the vector $l_2$ is greater than 0 degrees and smaller than 180 degrees, the coefficient $g_1$ and the coefficient $g_2$, which are used as gains, are uniquely determined. A method for calculating the coefficient $g_1$ and the coefficient $g_2$ is described in detail in the above Non-Patent Literature 1.

Figure 2:
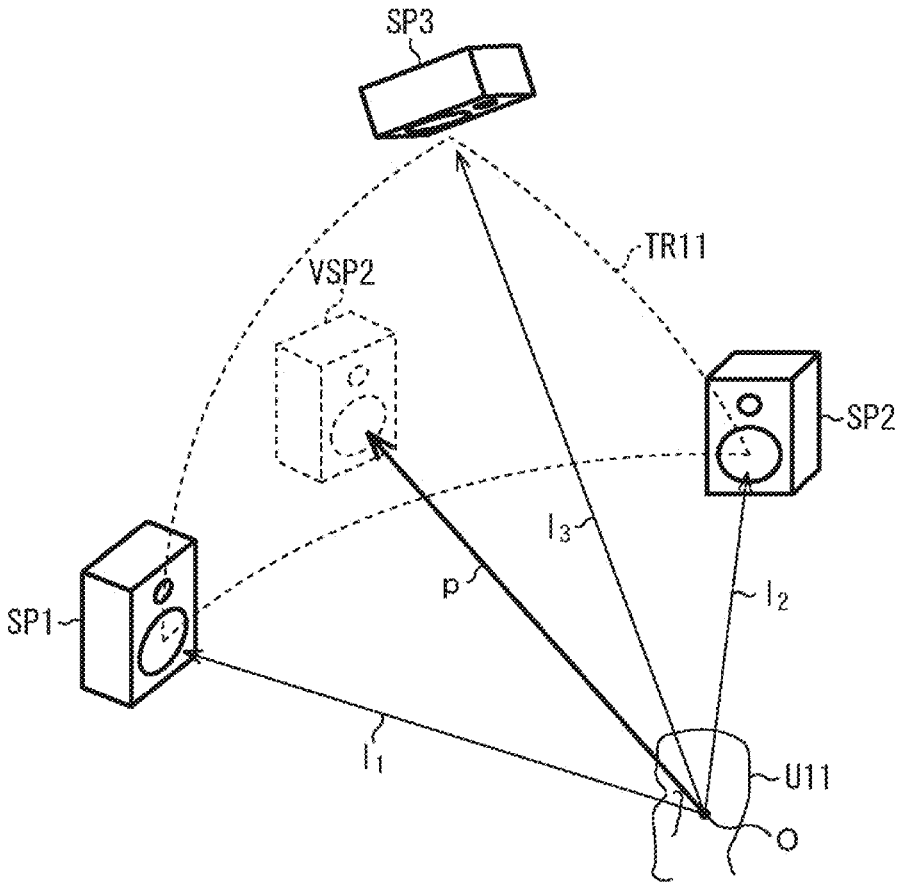
FIG. 2 is a diagram for describing three-dimensional VBAP.

In contrast to this, when three-channel sound is reproduced, the number of loudspeakers that output sound is three as shown in, for example, FIG. 2.

In the example of FIG. 2, three loudspeakers SP1, SP2, and SP3 output respective channel sounds.

Also, in such a case, there are three gains of the channel sounds output from the loudspeakers SP1 to SP3, i.e., three coefficients are calculated as these gains. These gains are considered or dealt with in a manner similar to that of the above two-dimensional VBAP.

Specifically, when a sound image is to be localized at a sound image position VSP2, the sound image position VSP2 is represented by a three-dimensional vector p originating from an origin O in a three-dimensional coordinate system where the origin O is the position of the head of a user U11.

Also, the vector p can be represented by a linear combination of a vector $l_1$ to a vector $l_3$ as shown in the following formula (2), where the vector $l_1$ to the vector $l_3$ are three-dimensional vectors pointing to the loudspeaker SP1 to the loudspeaker SP3, respectively, from the origin O as their starting point.

[Math 2]

$$p=g_1l_1+g_2l_2+g_3l_3 \tag{2}$$

In Formula (2), if a coefficient $g_1$ to a coefficient $g_3$ that are multiplied by the vector $l_1$ to the vector $l_3$ are calculated, and the coefficient $g_1$ to the coefficient $g_3$ are used as gains for respective output sounds of the loudspeaker SP1 to loudspeaker SP3, a sound image can be localized at the sound image position VSP2.

Such a technique of controlling a position where a sound image is to be localized, by calculating the coefficient $g_1$ to the coefficient $g_3$ using the position information of the three loudspeakers SP1 to SP3, is called three-dimensional VBAP.

In the example of FIG. 2, a sound image can be localized at any position within a triangular region TR11 on a spherical surface including the positions of the loudspeaker SP1, the loudspeaker SP2, and the loudspeaker SP3. Here, the region TR11 is a region on a spherical surface that has its center at the origin O and passes through the positions of the loudspeaker SP1 to the loudspeaker SP3. The region TR11 is also a triangular region surrounded by the loudspeaker SP1 to the loudspeaker SP3. In three-dimensional VBAP, the region TR11 is a mesh (hereinafter also referred to as a three-dimensional mesh).

Such three-dimensional VBAP can be used so that a sound image is to be localized at any position in space.

Figure 3:
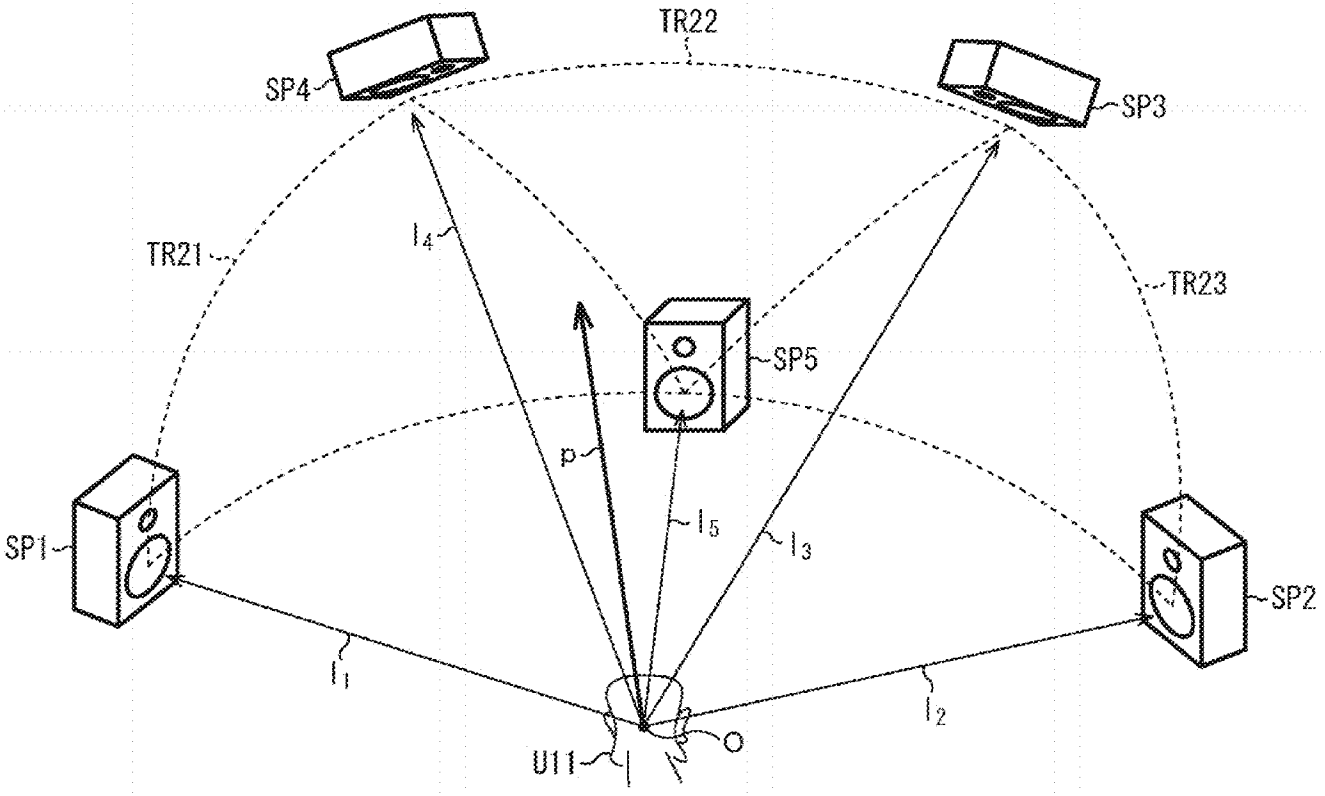
FIG. 3 is a diagram for describing a loudspeaker arrangement.

If the number of loudspeakers that output sound is increased as shown in, for example, FIG. 3 so that a plurality of regions similar to the triangular region TR11 shown in FIG. 2 are provided in space, a sound image can be localized at any position in these regions.

In the example shown in FIG. 3, five loudspeakers SP1 to SP5 are provided, and the loudspeaker SP1 to the loudspeaker SP5 output respective channel sounds. Here, the loudspeaker SP1 to the loudspeaker SP5 are provided on a spherical surface that has its center at an origin O that is at the position of the head of a user U11.

In this case, the gains of sounds output from the loudspeakers may be obtained by performing calculation similar to that for solving the above formula (2), where three-dimensional vectors pointing to the positions of the loudspeaker SP1 to the loudspeaker SP5 from the origin O as their starting point are represented by a vector $l_1$ to a vector $l_5$.

Here, of all regions on the spherical surface that has its center at the origin O, a triangular region surrounded by the loudspeaker SP1, the loudspeaker SP4, and the loudspeaker SP5 is represented by a region TR21. Similarly, of all regions on the spherical surface that has its center at the origin O, a triangular region surrounded by the loudspeaker SP3, the loudspeaker SP4, and the loudspeaker SP5 is represented by a region TR22, and a triangular region surrounded by the loudspeaker SP2, the loudspeaker SP3, and the loudspeaker SP5 is represented by a region TR23.

The region TR21 to the region TR23 are a region corresponding to the region TR11 shown in FIG. 2. In other words, in the example of FIG. 3, the region TR21 to the region TR23 are each a mesh. In the example of FIG. 3, a vector p indicates a position in the region TR21, where the vector p is a three-dimensional vector indicating a position where a sound image is intended to be localized.

Therefore, in this example, the gains of sounds output from the loudspeaker SP1, the loudspeaker SP4, and the loudspeaker SP5 are calculated by performing calculation similar to that for solving Formula (2) using the vector $l_1$, the vector $l_4$, and the vector $l_5$ indicating the positions of the loudspeaker SP1, the loudspeaker SP4, and the loudspeaker SP5. Also, in this case, the gains of sounds output from the other loudspeaker SP2 and loudspeaker SP3 are zero. In other words, the loudspeaker SP2 and the loudspeaker SP3 do not output sound.

If the five loudspeakers SP1 to SP5 are thus provided in space, a sound image can be localized at any position in a region including the region TR21 to the region TR23.

Incidentally, when there are a plurality of meshes in space, then if the coefficients of a sound image that is outside the ranges of all the meshes are calculated directly from Formula (2), at least one of the coefficient $g_1$ to the coefficient $g_3$ has a negative value, and therefore, the sound image cannot be localized in VBAP.

However, if the sound image is moved into the range of any mesh, the sound image can be usually localized in VBAP.

Note that if a sound image is moved, the sound image is away from a position where the sound image is originally intended to be localized before the movement. Therefore, the movement of a sound image should be minimized.

Figure 4:
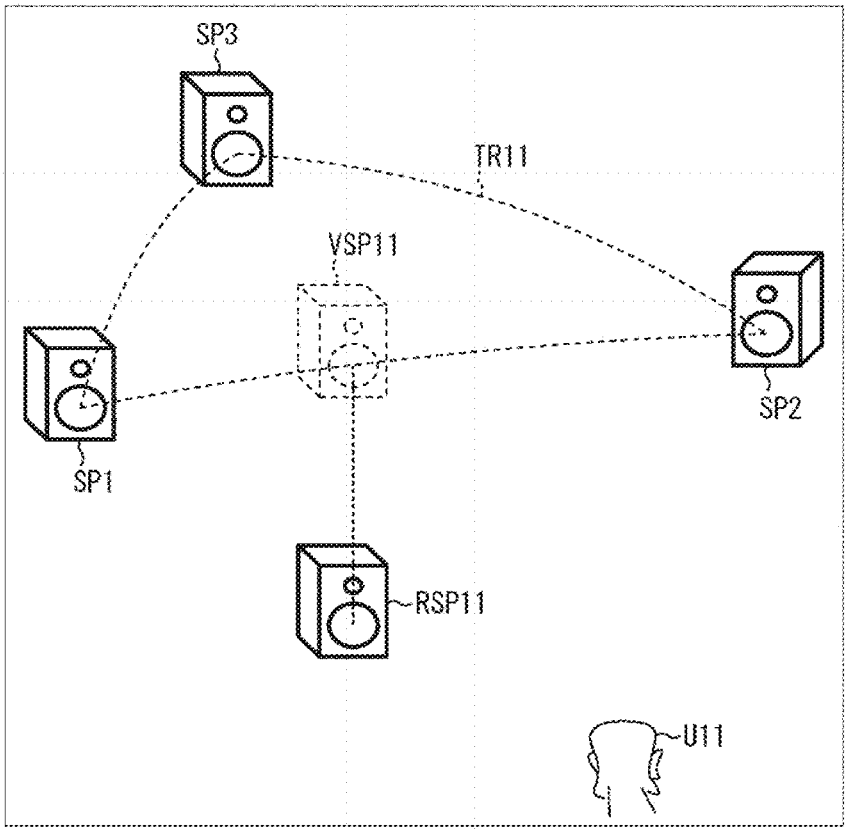
FIG. 4 is a diagram for describing a destination of a sound image.

As shown in, for example, FIG. 4, a sound image at a sound image position RSP11 that is to be reproduced may be moved into the region TR11 that is a mesh surrounded by the loudspeaker SP1 to the loudspeaker SP3, which will be discussed.

At this time, if a horizontal direction position (i.e., a position in the horizontal direction in the drawing) of a sound image to be moved is fixed, and the sound image is moved only in the vertical direction from the sound image position RSP11 so that the sound image is moved onto an arc connecting the loudspeaker SP1 and the loudspeaker SP2, the amount of the movement of the sound image can be minimized.

In this example, the destination of the sound image that is previously at the sound image position RSP11 is a sound image position VSP11. In general, human hearing is more sensitive to a movement of a sound image in the horizontal direction than in the vertical direction. Therefore, if a sound image is moved only in the vertical direction while the sound image position is fixed in the horizontal direction, a deterioration in sound quality due to the movement of the sound image can be reduced.

However, in the background art, not only it is necessary to perform large-scale calculation in order to move a sound image, but also it is not possible to move a sound image onto a boundary of a mesh, such as the sound image position VSP11 or the like.

Specifically, in the background art (see, for example, http://www.acoustics.hut.fi/research/cat/vbap/), VBAP calculation for allowing a sound image to be localized at a target position is initially performed for each mesh. Thereafter, if there is a mesh for which all coefficients that are a gain have a positive value, it is determined that the position of the sound image is within that mesh, and it is not necessary to move the sound image.

On the other hand, if the position of the sound image is not within any mesh, the sound image is moved in the vertical direction. When the sound image is moved in the vertical direction, the sound image is moved in the vertical direction by a predetermined quantity value, and VBAP calculation for the sound image position after the movement is performed for each mesh, to obtain coefficients that are a gain. Thereafter, if there is a mesh for which all coefficients calculated for the mesh have a positive value, that mesh is determined to be a mesh that contains the sound image position after the movement, and the gains of sound signals are adjusted using the calculated coefficients.

In contrast to this, there is no mesh for which all coefficients have a positive value, the position of the sound image is further moved by the predetermined quantity value. The above process is repeatedly performed unit1 the sound image position is moved into any mesh.

Therefore, a sound image position after movement is seldom present on the boundary of a mesh, and the movement amount of a sound image cannot be minimized. As a result, the movement amount of a sound image is large, so that the sound image position is far away from the original sound image position before movement.

Also, when a sound image is moved, it is necessary to calculate whether or not the sound image after the movement is within a mesh each time the sound image is moved, and therefore, the amount of calculation is likely to be huge.

Therefore, in the present technology, it is initially determined whether or not a sound image intended to be localized is outside the ranges of all meshes, before VBAP calculation. Thereafter, when the sound image is outside the meshes, the sound image is moved onto a boundary of a closest mesh in the vertical direction so that the movement amount of the sound image can be minimized and the amount of calculation necessary to localize the sound image can be reduced.

The present technology will now be described.

Figure 5:
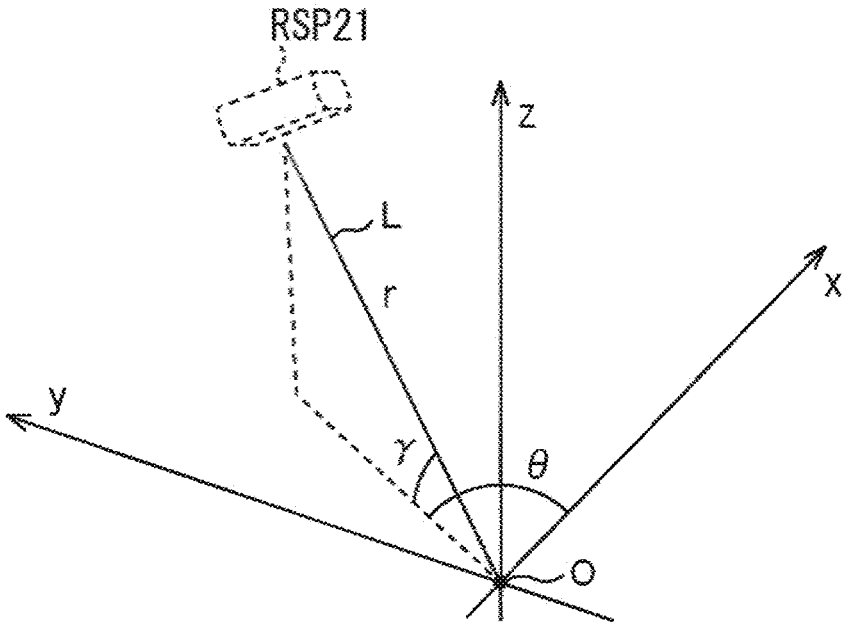
FIG. 5 is a diagram for describing position information of a sound image.

In the present technology, it is assumed that a sound image position, and a position of a loudspeaker that reproduces sound, are represented by a horizontal direction angle θ, a vertical direction angle γ, and a distance r to a viewer/listener, as shown in, for example, FIG. 5.

For example, it is assumed that there is a three-dimensional coordinate system that has its origin O at a position of a viewer/listener who is listening to object sounds output from loudspeakers (not shown), and has its x-axis, y-axis, and z-axis that are perpendicular to each other and extend along a diagonally upward right direction, a diagonally upward left direction, and an upward direction in the drawing. In this case, if a position of a sound image (sound source) corresponding to one object is a sound image position RSP21, the sound image may be localized at the sound image position RSP21 in the three-dimensional coordinate system.

Also, when a straight line connecting the sound image position RSP21 and the origin O is represented by a straight line L, an angle (azimuth angle) in the horizontal direction between the straight line L and the x-axis on the xy plane in the drawing, is a horizontal direction angle θ indicating a position in the horizontal direction of the sound image position RSP21. It is assumed that the horizontal direction angle θ has any value that satisfies $-180° \leq \theta \leq 180°$.

For example, the positive direction of the x-axis direction is assumed to correspond to $\theta=0°$, and the negative direction of the x-axis direction is assumed to correspond to $\theta=+180°=-180°$. Also, the counterclockwise direction around the origin O is assumed to correspond to the positive direction of θ, and the clockwise direction around the origin O is assumed to correspond to the negative direction of θ.

Moreover, an angle between the straight line L and the xy plane, i.e., an angle in the vertical direction (angle of elevation) in the drawing, is the vertical direction angle γ indicating a position in the vertical direction of the sound image position RSP21, and the vertical direction angle γ is assumed to have any value that satisfies $-90° \leq \gamma \leq 90°$. For example, the position of the xy plane is assumed to correspond to $\gamma=0°$, the upward direction in the drawing is assumed to correspond to the positive direction of the vertical direction angle γ, and the downward direction in the drawing is assumed to correspond to the negative direction of the vertical direction angle γ.

Also, the length of the straight line L, i.e., a distance from the origin O to the sound image position RSP21, is assumed to be the distance r to the viewer/listener, and the distance r is assumed to have a value of zero or more. In other words, the distance r is assumed to have a value that satisfies $0 \leq r \leq \infty$. Note that, in VBAP, all loudspeakers and a sound image have the same distance r to the viewer/listener, and the distance r is generally normalized to one for calculation. Therefore, in the description that follows, it is assumed that the position of each loudspeaker or a sound image has a distance r of one.

Also, in the description that follows, it is assumed that there are N meshes used in VBAP, and the positions of three loudspeakers forming an n-th mesh (note that $1 \leq n \leq N$) are defined by $(\theta_{n1}, \gamma_{n1})$, $(\theta_{n2}, \gamma_{n2})$, and $(\theta_{n3}, \gamma_{n3})$ using a horizontal direction angle θ and a vertical direction angle γ. Specifically, for example, the horizontal direction angle θ of a first loudspeaker forming the n-th mesh is represented by $\theta_{n1}$, and the vertical direction angle $\gamma$ of that loudspeaker is represented by $\gamma_{n1}$.

Note that, in the case of two-dimensional VBAP, the positions of two loudspeakers forming a mesh are defined by $(\theta_{n1}, \gamma_{n1})$ and $(\theta_{n2}, \gamma_{n2})$ using a horizontal direction angle $\theta$ and a vertical direction angle $\gamma$.

Firstly, a method for moving a sound image to be moved by the present technology (hereinafter also referred to as a target sound image) onto a boundary line of a predetermined mesh, i.e., an arc that is a mesh boundary, will be described.

In the above three-dimensional VBAP, the three coefficients $g_1$ to $g_3$ can be obtained from an invertible matrix $L_{123}^{-1}$ of a triangular mesh and a position p of a target sound image by calculation using the following formula (3).

[Math 3] (3)

$$\begin{bmatrix} g_1 \\ g_2 \\ g_3 \end{bmatrix} = pL_{123}^{-1} = [\ p_1 \quad p_2 \quad p_3] \begin{bmatrix} l_{11} & l_{12} & l_{13} \\ l_{21} & l_{22} & l_{23} \\ l_{31} & l_{32} & l_{33} \end{bmatrix}^{-1}$$

Note that, in Formula (3), $p_1$, $p_2$, and $p_3$ represent coordinates on the x-axis, y-axis, and z-axis of an orthogonal coordinate system (i.e., the xyz coordinate system shown in FIG. 5) indicating the position of a target sound image.

Also, $l_{11}$, $l_{12}$, and $l_{13}$ represent the values of an x-component, a y-component, and a z-component when the vector $l_1$ pointing to a first loudspeaker forming the mesh is represented by components on the x-axis, y-axis, and z-axis, and correspond the x-coordinate, y-coordinate, and z-coordinate of the first loudspeaker.

Similarly, $l_{21}$, $l_{22}$, and $l_{23}$ represent the values of an x-component, a y-component, and a z-component when the vector $l_2$ pointing to a second loudspeaker forming the mesh is represented by components on the x-axis, y-axis, and z-axis. Also, $l_{31}$, $l_{32}$, and $l_{33}$ represent the values of an x-component, a y-component, and a z-component when the vector $l_3$ pointing to a third loudspeaker forming the mesh is represented by components on the x-axis, y-axis, and z-axis.

Also, the elements of the invertible matrix $L_{123}^{-1}$ of the mesh are represented by the following formula (4).

[Math 4] (4)

$$L_{123}^{-1} = \begin{bmatrix} l_{11} & l_{12} & l_{13} \\ l_{21} & l_{22} & l_{23} \\ l_{31} & l_{32} & l_{33} \end{bmatrix}^{-1} = \begin{bmatrix} l'_{11} & l'_{12} & l'_{13} \\ l'_{21} & l'_{22} & l'_{23} \\ l'_{31} & l'_{32} & l'_{33} \end{bmatrix}$$

Moreover, a conversion from the xyz coordinate system into the coordinates $\theta$, $\gamma$, and r of a spherical coordinate system is defined by the following formula (5), where r=1.

[Math 5] (5)

$$\begin{bmatrix} p_1 \\ p_2 \\ p_3 \end{bmatrix} = \begin{bmatrix} \cos(\theta) \times \cos(\gamma) \\ \sin(\theta) \times \cos(\gamma) \\ \sin(\gamma) \end{bmatrix}$$

In VBAP, when a sound image is to be localized on an arc that is a mesh boundary, the gain (coefficient) of a loudspeaker that is not on that arc is zero. Therefore, when a target sound image is moved onto one boundary of a mesh, one of the gains of the loudspeakers for allowing a sound image to be localized at a position after the movement, more specifically, one of the gains of sound signals reproduced by the loudspeakers, is zero.

Therefore, that a sound image is moved onto a boundary of a mesh can mean that the sound image is moved to a position that causes one of the three loudspeakers forming a mesh to have a gain of zero.

For example, if a target sound image is moved to a position that causes the gain $g_i$ of an i-th loudspeaker (note that $1 \leq i \leq 3$) of the three loudspeakers to be zero while the horizontal direction angle $\theta$ of the target sound image is fixed, the following formula (6) obtained by modifying Formula (3) is established.

[Math 6] (6)

$$\begin{aligned} g_i &= p_1 l'_{1i} + p_2 l'_{2i} + p_3 l'_{3i} \\ &= \cos(\theta) \times \cos(\gamma) \times l'_{1i} + \sin(\theta) \times \cos(\gamma) \times l'_{2i} + \sin(\gamma) l'_{3i} = 0 \end{aligned}$$

The following formula (7) is obtained by solving the equation represented by Formula (6).

[Math 7] (7)

$$\gamma = \arctan\left(-\frac{\cos(\theta) \times l'_{1i} + \sin(\theta) \times l'_{2i}}{l'_{3i}}\right)$$

In Formula (7), the vertical direction angle $\gamma$ is the vertical direction angle of the position of the destination of the target sound image. Also, in Formula (7), the horizontal direction angle $\theta$ is the horizontal direction angle of the destination of the target sound image. Because the target sound image is not moved in the horizontal direction, the horizontal direction angle $\theta$ of the target sound image has the same value as that before the movement.

Therefore, if the invertible matrix $L_{123}^{-1}$ of the mesh, the horizontal direction angle $\theta$ of the target sound image before movement, and a loudspeaker forming the mesh and whose gain (coefficient) is zero, are known, the vertical direction angle $\gamma$ of the position of the destination of the target sound image can be obtained. Note that, in the description that follows, the position of the destination of a target sound image is also referred to as a movement destination position.

Note that, in the foregoing, a method for calculating a movement destination position when three-dimensional VBAP is performed has been described. Also, when two-dimensional VBAP is performed, a movement destination position can be calculated in a manner similar to that of three-dimensional VBAP.

Specifically, in the case of two-dimensional VBAP, if, in addition to two loudspeakers forming a mesh, a virtual loudspeaker is added to any position that is not on a great circle passing through the two loudspeakers, the problem of two-dimensional VBAP can be solved in the same manner as that for the problem of three-dimensional VBAP. Specifically, if Formula (7) is calculated for two loudspeakers forming a mesh and an additional virtual loudspeaker, the movement destination position of the target sound image can be obtained. In this case, a position where the single additional virtual loudspeaker has a gain (coefficient) of zero is a position where the target sound image is to be moved.

Note that, even in the case of three-dimensional VBAP, if, in addition to two loudspeakers placed at opposite ends of one boundary of a mesh, one virtual loudspeaker is added to any position that is not on a great circle passing through the two loudspeakers, and Formula (7) is calculated, the movement destination position can be obtained.

Therefore, in Formula (7), if at least the position information of two loudspeakers placed at opposite ends of a boundary of a mesh that is the destination of the target sound image, and the horizontal direction angle θ of the target sound image, are known, the movement destination position of the target sound image can be obtained.

Also, a method for calculating the invertible matrix $L_{123}^{-1}$ of the mesh is the same as when the gain (coefficient) of each loudspeaker is derived according to VBAP, and is described in Non-Patent Literature 1. Therefore, the invertible matrix calculation method will not be herein described in detail.

Next, assuming that it is necessary to move a sound image, a method of detecting a mesh at a position that is the destination of a sound image, of all meshes provided around a user who is a viewer/listener, in a space where the user is present, and one of loudspeakers forming the mesh whose gain is zero, will be described. Also, assuming that it is not necessary to move a sound image, a method of detecting a mesh that may contain the sound image position will be described.

Firstly, it is determined whether three-dimensional VBAP or two-dimensional VBAP is to be performed for each object sound in a subsequent step, and a process corresponding to the determination result is performed.

For example, it is assumed that, when all meshes in space where the user is present are a two-dimensional mesh, i.e., a mesh formed by two loudspeakers, two-dimensional VBAP is performed. In contrast to this, when at least one of all meshes is a three-dimensional mesh, i.e., a mesh formed by three loudspeakers, three-dimensional VBAP is performed.

<Process in Two-Dimensional VBAP>

When it is determined that two-dimensional VBAP is to be performed in a subsequent step, the following process 2D(1) to process 2D(4) are performed to determine whether or not it is necessary to move a sound image, and the destination of the movement.

(Process 2D(1))

Initially, in the process 2D(1), a left limit value $\theta_{nl}$ that is a horizontal direction angle at a left limit position, and a right limit value $\theta_{nr}$ that is a horizontal direction angle at a right limit position, are calculated using the following formula (8), where the left limit position and the right limit position are positions of opposite ends of an n-th two-dimensional mesh, i.e., positions of opposite ends of an arc that is a mesh boundary connecting two loudspeakers.

[Math 8]

$$\begin{aligned}&\text{if } (\theta_{n1}<\theta_{n2}\&(\theta_{n1}-\theta_{n2}<-180°)) \text{ or } (\theta_{n1}>\theta_{n2}\&(\theta_{n1}-\theta_{n2}>180°))\\&\theta_{nl}=\theta_{n1};\theta_{nr}=\theta_{n2};\\&\text{else}\\&\theta_{nl}=\theta_{n2};\theta_{nr}=\theta_{n1};\end{aligned} \tag{8}$$

Typically, of the horizontal direction angle $\theta_{n1}$ of a first loudspeaker forming the n-th two-dimensional mesh and the horizontal direction angle $\theta_{n2}$ of a second loudspeaker forming the n-th two-dimensional mesh, one that has a smaller angle θ is the left limit value $\theta_{nl}$, and one that has a larger angle θ is the right limit value $\theta_{nr}$. In other words, a loudspeaker position having a smaller horizontal direction angle is a left limit position, and a loudspeaker position having a larger horizontal direction angle is a right limit position.

Note that when an arc that is a mesh boundary includes a point of θ=180° in a spherical coordinate system, i.e., a difference between the horizontal direction angles of two loudspeakers exceeds 180°, a loudspeaker position that has a larger horizontal direction angle is a left limit position.

A process of determining a left limit value and a right limit value by calculation of Formula (8) is performed for N meshes.

(Process 2D(2))

Next, in the process 2D(2), after a left limit value and a right limit value have been determined for all meshes, a mesh including a horizontal direction position indicated by the horizontal direction angle θ of the target sound image is detected from all meshes by calculation of the following formula (9). Specifically, a mesh on which the target sound image is between a left limit position and a right limit position in the horizontal direction, is detected.

[Math 9]

$$\begin{aligned}&\text{if } (\theta_{nl}\le\theta\le\theta_{nr}) \text{ or } (\theta_{nl}>\theta_{nr}\&((\theta_{nl}\le\theta) \text{ or } (\theta\le\theta_{nr})))\\&\quad\text{the n-th mesh includes the horizontal direction position of the sound image}\\&\text{else}\\&\quad\text{the n-th mesh does not include the horizontal direction position of the sound image}\end{aligned} \tag{9}$$

Note that when no mesh that includes the horizontal direction position of the target sound image has been detected, a mesh that has a left limit position or right limit position closest to the position of the target sound image is detected, and a loudspeaker position that is the left limit position or right limit position of the detected mesh is the position of the destination of the target sound image. In this case, information indicating the detected mesh is output, and the process 2D(3) and the process 2D(4) described below are not necessary.

(Process 2D(3))

After a mesh including the horizontal direction position of the target sound image has been detected by the process 2D(2), the process 2D(3) is performed to calculate a movement destination candidate position that is a candidate for the movement destination position of the target sound image for each detected mesh.

Although a movement destination candidate position is specified by a horizontal direction angle θ and a vertical direction angle γ, the horizontal direction angle remains fixed, and therefore, in the description that follows, a vertical direction angle indicating a movement destination candidate position is also simply referred to as a movement destination candidate position.

In the process 2D(3), initially, it is determined whether or not the left limit value and right limit value of the n-th mesh to be processed are the same as each other.

Thereafter, if the left limit value and the right limit value are the same as each other, one of the vertical direction angle of the left limit position and the vertical direction angle of the right limit position that is closer to the vertical direction angle γ of the target sound image, i.e., that has a smaller difference, is a movement destination candidate position $\gamma_{nD}$. More specifically, the vertical direction angle of one of the right limit position and the left limit position that is closer to the target sound image is the vertical direction angle $\gamma_{nD}$ indicating a movement destination candidate position calculated for the n-th mesh.

In contrast to this, when the left limit value and the right limit value are different from each other, one virtual loudspeaker is added to the two-dimensional mesh, and this virtual loudspeaker and the loudspeakers placed at the right limit position and the left limit position form a triangular three-dimensional mesh. For example, as the virtual loudspeaker, a top loudspeaker placed directly above the user, i.e., at a position having the vertical direction angle $\gamma=90°$ (hereinafter also referred to as a top position), is added.

Thereafter, the invertible matrix $L_{123}^{-1}$ of this three-dimensional mesh is obtained by calculation, and a vertical direction angle with which the coefficient (gain) of the additional virtual loudspeaker is zero, is obtained as the movement destination candidate position $\gamma_{nD}$ of the target sound image using the above formula (7).

In Formula (7), the movement destination candidate position $\gamma_{nD}$ can be obtained if the position information of loudspeakers placed at the left limit position and the right limit position, and the horizontal direction angle $\theta$ of the target sound image, are known.

(Process 2D(4))

After the movement destination candidate position $\gamma_{nD}$ has been calculated by the process 2D(3) for each mesh, the process 2D(4) determines whether or not it is necessary to move the target sound image, based on the calculated movement destination candidate position $\gamma_{nD}$, and the sound image position is moved, depending on the determination result.

Specifically, of the calculated movement destination candidate positions $\gamma_{nD}$, one whose vertical direction angle is closest to the vertical direction angle $\gamma$ of the target sound image before movement is detected, and it is determined whether or not the movement destination candidate position $\gamma_{nD}$ obtained by the detection matches the vertical direction angle $\gamma$ of the target sound image.

At this time, if the movement destination candidate position $\gamma_{nD}$ matches the vertical direction angle $\gamma$ of the target sound image, it is determined that it is not necessary to move the target sound image, because a position specified by the movement destination candidate position $\gamma_{nD}$ is directly the position of the target sound image before movement. In this case, information indicating each mesh including the horizontal direction position of the target sound image detected in the process 2D(2) (hereinafter also referred to as identification information) is output, and utilized as information indicating a mesh on which two-dimensional VBAP is performed.

Note that because a mesh for which the movement destination candidate position $\gamma_{nD}$ matching the vertical direction angle $\gamma$ of the target sound image has been calculated, is a mesh where the target sound image is present, only identification information indicating that mesh may be output.

In contrast to this, if the movement destination candidate position $\gamma_{nD}$ does not match the vertical direction angle $\gamma$ of the target sound image, it is determined that it is necessary to move the target sound image, and the movement destination candidate position $\gamma_{nD}$ is the final movement destination position of the target sound image. More specifically, the movement destination candidate position $\gamma_{nD}$ is determined to be a vertical direction angle indicating the movement destination position of the target sound image. Thereafter, the movement destination position as information indicating the destination of the target sound image, and the identification information of a mesh for which the movement destination candidate position $\gamma_{nD}$ which is the movement destination position has been calculated, are output, and the movement destination position and the identification information are utilized for calculation in two-dimensional VBAP.

<Process in Three-Dimensional VBAP>

Also, when three-dimensional VBAP is to be performed in a subsequent step, the following process 3D(1) to process 3D(6) are performed to determine whether or not it is necessary to move a sound image, and the destination.

(Process 3D(1))

Initially, in the process 3D(1), it is determined whether or not a top loudspeaker and a bottom loudspeaker are among loudspeakers placed around the user. Here, the bottom loudspeaker is a loudspeaker that is placed directly below the user, more specifically, a loudspeaker that is placed at a position having the vertical direction angle $\gamma=-90°$ (hereinafter also referred to as a bottom position).

Therefore, a case where a top loudspeaker is present is a case where a loudspeaker is present at a highest position in the vertical direction, i.e., a position having a greatest possible vertical direction angle $\gamma$. Similarly, a case where a bottom loudspeaker is present is a case where a loudspeaker is present at a lowest position in the vertical direction, i.e., a position having a smallest possible vertical direction angle $\gamma$.

When the target sound image is moved in the vertical direction, there are two movements: an upward movement from bottom, i.e., a movement in a direction in which the vertical direction angle increases; and a downward movement from top, i.e., a movement in a direction in which the vertical direction angle decreases.

Also, as VBAP meshes are assumed to have no gap between adjacent meshes, it is not necessary to move a sound image downward from top if a top loudspeaker is present. Similarly, if a bottom loudspeaker is present, it is not necessary to move a sound image upward from bottom. Therefore, in the process 3D(1), in order to determine whether or not it is necessary to move a sound image, it is determined whether or not a top loudspeaker and a bottom loudspeaker are present.

(Process 3D(2))

Next, in the process 3D(2), calculated are the left limit value $\theta_{nl}$ and right limit value $\theta_{nr}$ of each mesh, and an intermediate value $\theta_{nmid}$ that is the horizontal direction angle of a loudspeaker placed between the left limit position and the right limit position in the horizontal direction in the mesh. Moreover, it is determined whether or not the mesh includes a top position or a bottom position. Note that, in the description that follows, a position between a left limit position and a right limit position, that is indicated by the intermediate value $\theta_{nmid}$, is also referred to as an intermediate position.

In the process 3D(2), different processes are performed, depending on whether a mesh is a three-dimensional mesh or a two-dimensional mesh.

For example, if a mesh is a three-dimensional mesh, the following processes 3D(2.1)-1 to 3D(2.4)-1 are performed as the process 3D(2).

Specifically, in the process 3D(2.1)-1, the horizontal direction angle $\theta_{n1}$, horizontal direction angle $\theta_{n2}$, and horizontal direction angle $\theta_{n3}$ of three loudspeakers forming an n-th mesh are assorted in order of magnitude, smallest first, and are referred to as a horizontal direction angle $\theta_{nlow1}$, horizontal direction angle $\theta_{nlow2}$, and horizontal direction angle $\theta_{nlow3}$. Here, $\theta_{nlow1} \leq \theta_{nlow2} \leq \theta_{nlow3}$.

Next, in the process 3D(2.2)-1, a difference $diff_{n1}$, difference $diff_{n2}$, and difference $diff_{n3}$ of the horizontal direction angles θ are calculated using the following formula (10).

[Math 10]

$$diff_{n1}=\theta_{nlow2}-\theta_{nlow1};$$

$$diff_{n2}=\theta_{nlow3}-\theta_{nlow2};$$

$$diff_{n3}=\theta_{nlow1}+360°-\theta_{nlow3}; \quad (10)$$

Thereafter, in the process 3D(2.3)-1, the following formula (11) is calculated, and any value of the horizontal direction angle $\theta_{nlow1}$ to horizontal direction angle $\theta_{nlow3}$ of a mesh to be processed is selected as each value of the left limit value $\theta_{nl}$, right limit value $\theta_{nr}$, and intermediate value $\theta_{nmid}$.

[Math 11]

if ($diff_{n1}\geq 180°$)

$\theta_{nl}=\theta_{nlow1};\theta_{nr}=\theta_{nlow2};\theta_{nmid}=\theta_{nlow3};$ else if ($diff_{n2}\geq 180°$)

$\theta_{nl}=\theta_{nlow2};\theta_{nr}=\theta_{nlow3};\theta_{nmid}=\theta_{nlow1};$ else if ($diff_{n3}\geq 180°$)

$\theta_{nl}=\theta_{nlow3};\theta_{nr}=\theta_{nlow1};\theta_{nmid}=\theta_{nlow2};$ (11)

else the n-th mesh is a mesh including a top position or a bottom position

Specifically, in Formula (11), it is determined whether or not any of the difference $diff_{n1}$ to difference $diff_{n3}$ calculated in the process 3D(2.2)-1 has a value of 180° or more.

Thereafter, if there is one that has a difference of 180° or more, it is determined that the mesh to be processed is a mesh that includes neither a top position nor a bottom position, and the left limit value $\theta_{nl}$, the right limit value $\theta_{nr}$, and the intermediate value $\theta_{nmid}$ are determined based on the horizontal direction angle $\theta_{nlow1}$ to the horizontal direction angle $\theta_{nlow3}$.

In contrast to this, if there is no one that has a difference of 180° or more, it is determined that the mesh to be processed is a mesh that has a top position or a bottom position. In other words, the mesh to be processed includes a top position or a bottom position.

In the process 3D(2.4)-1, three-dimensional VBAP calculation is performed for a mesh that it has been determined in the process 3D(2.3)-1 includes a top position or a bottom position. Specifically, assuming that the top position is the position of a sound image to be localized, i.e., a position indicated by the vector p, the coefficient (gain) of each loudspeaker is calculated by the above formula (3) using the invertible matrix $L_{123}^{-1}$ of the mesh.

As a result, if the obtained coefficient $g_1$ to coefficient $g_3$ are all negative, the mesh to be processed is a mesh including a top position, and in this case, it is not necessary to move the target sound image downward from top. Specifically, when there is a mesh that includes a highest possible position in the vertical direction, it is not necessary to move the target sound image downward from top.

Conversely, if any of the obtained coefficient $g_1$ to coefficient $g_3$ has a negative value, the mesh is a mesh including a bottom position, and in this case, it is not necessary to move the target sound image upward from bottom. Specifically, when there is a mesh that includes a lowest possible position in the vertical direction, it is not necessary to move the target sound image upward from bottom.

Also, when the mesh to be processed is a two-dimensional mesh, the process 3D(2.1)-2 is performed as the process 3D(2).

In the process 3D(2.1)-2, a process similar to the process 2D(1) is performed to calculate the left limit value $\theta_{nl}$ and the right limit value $\theta_{nr}$ using Formula (8) for each mesh.

(Process 3D(3))

Next, in the process 3D(3), of all meshes, a mesh including a horizontal direction position indicated by the horizontal direction angle θ of the target sound image in the horizontal direction, is detected. Note that, in the process 3D(3), the same process is performed irrespective of whether a mesh is a two-dimensional mesh or a three-dimensional mesh.

Specifically, when a mesh to be processed has a left limit position and a right limit position, a mesh on which the target sound image is placed between the left limit position and the right limit position in the horizontal direction is detected using the following formula (12).

[Math 12]

if ($\theta_{nl}\leq\theta\leq\theta_{nr}$) or ($\theta_{nl}>\theta_{nr}$&(($\theta_{nl}\leq\theta$) or ($\theta\leq\theta_{nr}$))) (12)

the n-th mesh includes the horizontal direction position of the sound image else the n-th mesh doe of include the horizontal direction position of the sound image Also, a mesh that has neither a left limit position nor a right limit position, i.e., a mesh that includes either a top position or a bottom position, always includes the horizontal direction position of the target sound image in the horizontal direction.

Note that when no mesh that includes the horizontal direction position of the target sound image has been detected, a mesh that has a left limit position or right limit position closest to the target sound image in the horizontal direction is detected, and the target sound image is assumed to be moved to the left limit position or right limit position of the detected mesh. In this case, the identification information of the detected mesh is output, and it is not necessary to perform the subsequent process 3D(4) to process 3D(6).

Also, when, of meshes including the horizontal direction position of the target sound image, at least one three-dimensional mesh has been detected, then if it is determined that it is not necessary to move the target sound image downward from top and it is not necessary to move the target sound image upward from bottom, it is not necessary to perform the subsequent process 3D(4) to process 3D(6). In this case, it is assumed that the target sound image is not moved, and the identification information of the detected mesh is output, and it is not necessary to perform the subsequent process 3D(4) to process 3D(6).

(Process 3D(4))

When, in the process 3D(3), a mesh that includes the horizontal direction position of the target sound image has been detected, a mesh boundary line that is a target to which the target sound image is to be moved, i.e., a mesh arc, is specified for the detected mesh in the process 3D(4).

Here, a mesh boundary line that is a movement target is a boundary line to which the target sound image can get when the target sound image is moved in the vertical direction. In other words, such a boundary line is a boundary line that includes the position of the horizontal direction angle θ of the target sound image in the horizontal direction.

Note that when a mesh to be processed is a two-dimensional mesh, the two-dimensional mesh is directly an arc that is a target to which the target sound image is to be moved.

When a mesh to be processed is a three-dimensional mesh, specifying an arc that is a target to which the target sound image is to be moved is equivalent to specifying a loudspeaker for which a coefficient (gain) for allowing a sound image to be localized at a movement destination position in VBAP is zero.

For example, when a mesh to be processed is a mesh that has a left limit position and a right limit position, a loudspeaker having a coefficient of zero is determined using the following formula (13).

[Math 13] (13)

$$\text{if } (\theta_{nl} > \theta_{nr}),$$

$$\left\{\begin{array}{c} \theta_{nr} = \theta_{nr} + 360°; \\ \text{if } (\theta_{nl} > \theta_{nmid}), \\ \theta_{nmid} = \theta_{nmid} + 360°; \\ \text{if } (\theta < 0°), \\ \theta = \theta + 360°; \end{array}\right\}$$

$$\text{if } (\theta < \theta_{nmid})$$

type1;

else type2;

In Formula (13), initially, the left limit value $\theta_{nl}$, right limit value $\theta_{nr}$, and intermediate value $\theta_{nmid}$ of the mesh, and the horizontal direction angle $\theta$ of the target sound image, are optionally modified so that $\theta_{nl} \leq \theta_{nmid} \leq \theta_{nr}$.

Thereafter, if the horizontal direction angle $\theta$ of the target sound image is smaller than the intermediate value $\theta_{nmid}$, it is determined that the mesh to be processed is of type1. If it is determined that the mesh to be processed is of type1, loudspeakers that are placed at a right limit position and an intermediate position may be a loudspeaker having a coefficient of zero. In this case, a process of calculating a movement destination candidate position, assuming that the loudspeaker at the right limit position is a loudspeaker having a coefficient of zero, is performed, and a process of calculating a movement destination candidate position, assuming that the loudspeaker at the intermediate position is a loudspeaker having a coefficient of zero, is also performed.

If the horizontal direction angle $\theta$ is smaller than the intermediate value $\theta_{nmid}$, the target sound image is closer to the left limit position than to the intermediate position, and therefore, an arc connecting the intermediate position and the left limit position, and an arc connecting the left limit position and the right limit position, may be the destination of the target sound image.

Also, in Formula (13), if the horizontal direction angle $\theta$ of the target sound image is greater than or equal to the intermediate value $\theta_{nmid}$, it is determined that the mesh to be processed is of type2. If it is determined that the mesh to be processed is of type2, a loudspeaker placed between the left limit position and the intermediate position may be a loudspeaker having a coefficient of zero.

Moreover, for a mesh that has neither a left limit position nor a right limit position, i.e., a mesh that includes a top position or a bottom position, a loudspeaker having a coefficient of zero is specified using the following formula (14).

[Math 14]

$$\text{if } (\theta_{nlow1} \leq \theta < \theta_{nlow2})$$

type3;

$$\text{else if } (\theta_{nlow2} \leq \theta < \theta_{nlow3})$$

type4;

else type5; (14)

In Formula (14), it is determined which of type3 to type5 is the type of the mesh to be processed, based on a relationship between the horizontal direction angle of each loudspeaker of the mesh to be processed, and the horizontal direction angle $\theta$ of the target sound image.

If it is determined that the mesh to be processed is of type3, it is determined that a loudspeaker at a position having the horizontal direction angle $\theta_{low3}$, i.e., a loudspeaker having the greatest horizontal direction angle, is a loudspeaker having a coefficient of zero.

Also, if it is determined that the mesh to be processed is of type4, it is determined that a loudspeaker at a position having the horizontal direction angle $\theta_{nlow1}$, i.e., a loudspeaker having the smallest horizontal direction angle, is a loudspeaker having a coefficient of zero. If it is determined that the mesh to be processed is of type5, it is determined that a loudspeaker at a position having the horizontal direction angle $\theta_{nlow2}$, i.e., a loudspeaker having the second smallest horizontal direction angle, is a loudspeaker having a coefficient of zero.

(Process 3D(5))

After an arc of a mesh that is a target for movement of the target sound image has been specified in the process 3D(4), the movement destination candidate position $\gamma_{nD}$ of the target sound image is calculated in the process 3D(5). In the process 3D(5), different processes are performed, depending on whether a mesh to be processed is a two-dimensional mesh or a three-dimensional mesh.

For example, if a mesh to be processed is a three-dimensional mesh, a process 3D(5)-1 is performed as the process 3D(5).

In the process 3D(5)-1, the calculation of the above formula (7) is performed based on information of the loudspeaker having a coefficient of zero specified in the process 3D(4), the horizontal direction angle $\theta$ of the target sound image, and the invertible matrix $L_{123}^{-1}$ of the mesh, and the obtained vertical direction angle $\gamma$ is the movement destination candidate position $\gamma_{nD}$. In other words, the target sound image is moved in the vertical direction to a position on a boundary line of the mesh that is at the same position as that of the horizontal direction position of the target sound image in the horizontal direction while the position in the horizontal direction remains fixed. Here, the invertible matrix of the mesh can be obtained from the position information of the loudspeakers.

Note that if the mesh to be processed is of type1 or type2, i.e., the mesh to be processed is a mesh having two loudspeakers that may have a coefficient of zero, that has been specified in the process 3D(4), the movement destination candidate position $\gamma_{nD}$ is calculated for each of the two loudspeakers.

Also, if the mesh to be processed is a two-dimensional mesh, a process 3D(5)-2 is performed as the process 3D(5). In the process 3D(5)-2, a process similar to the above process 2D(3) is performed to calculate the movement destination candidate position $\gamma_{nD}$.

(Process 3D(6))

Finally, in the process 3D(6), it is determined whether or not it is necessary to move the target sound image, and based on the determination result, the sound image is moved.

Typically, in the VBAP mesh arrangement, even when a three-dimensional mesh and a two-dimensional mesh coexist, only one of the movement destination candidate position $\gamma_{nD}$ for the three-dimensional mesh and the movement destination candidate position $\gamma_{nD}$ for the two-dimensional mesh is obtained.

When the movement destination candidate position $\gamma_{nD}$ has been obtained for a three-dimensional mesh, it is determined whether or not it is necessary to move the target sound image downward from top, and whether or not it is necessary to move the target sound image upward from bottom.

Specifically, if the process 3D(1) has determined that there is no top loudspeaker, and the result of the process 3D(2.4)-1 shows that there is no mesh including a top position, it is determined that it is necessary to move the target sound image downward from top.

In this case, if a movement destination candidate position $\gamma_{nD_max}$ is smaller than the vertical direction angle $\gamma$ of the target sound image, where the movement destination candidate position $\gamma_{nD_max}$ is one of the movement destination candidate positions $\gamma_{nD}$ obtained in the process 3D(5)-1 that has a greatest value, the movement destination candidate position $\gamma_{nD_max}$ is the final movement destination position.

In other words, if the movement destination candidate position $\gamma_{nD}$ that is at a highest position in the vertical direction is at a position lower than the position in the vertical direction of the target sound image, it is determined that it is necessary to move the target sound image, and the target sound image is moved to the movement destination candidate position $\gamma_{nD}$ that it has been determined is a movement destination position.

If the target sound image is to be moved, the movement destination position as information indicating the destination of the target sound image (more specifically, the movement destination candidate position $\gamma_{nD_max}$ as the vertical direction angle of the movement destination position), and the identification information of a mesh for which the movement destination candidate position has been calculated, are output.

Alternatively, if the process 3D(1) has determined that there is no bottom loudspeaker, and the result of the process 3D(2.4)-1 shows that there is no mesh including a bottom position, it is determined that it is necessary to move the target sound image upward from bottom.

In this case, if a movement destination candidate position $\gamma_{nD_min}$ is larger than the vertical direction angle $\gamma$ of the target sound image, where the movement destination candidate position $\gamma_{nD_min}$ is one of the movement destination candidate positions $\gamma_{nD}$ obtained in the process 3D(5)-1 that has a minimum value, the movement destination candidate position $\gamma_{nD_min}$ is the final movement destination position.

In other words, if the movement destination candidate position $\gamma_{nD}$ that is at a lowest position in the vertical direction is at a position higher than the position in the vertical direction of the target sound image, it is determined that it is necessary to move the target sound image, and the target sound image is moved to the movement destination candidate position $\gamma_{nD}$ that it has been determined is a movement destination position.

If the target sound image is to be moved, the movement destination position as information indicating the destination of the target sound image (more specifically, the movement destination candidate position $\gamma_{nD_min}$ as the vertical direction angle of the movement destination position), and the identification information of a mesh for which the movement destination candidate position has been calculated, are output.

In contrast to this, if the movement destination position of the target sound image has not been obtained by the above process, for example, it has been determined that it is not necessary to move downward from top or upward from bottom, the target sound image is within one of the meshes. In such a case, identification information indicating each mesh including the horizontal direction position of the target sound image, that has been detected in the process 3D(3), is output as a mesh on which the target sound image may be present.

Also, if the movement destination candidate position $\gamma_{nD}$ has been obtained for two-dimensional mesh, a process similar to the process 2D(4) is performed.

Note that the presence or absence of a top loudspeaker or a bottom loudspeaker, and the presence or absence of a mesh including a top position or a bottom position, depend on the position relationship between loudspeakers forming a mesh. Therefore, in the process 3D(6), it can be said that it is determined whether or not it is necessary to move the target sound image, i.e., it is determined whether or not the target sound image is outside a mesh, based on at least either the position relationship between loudspeakers forming the mesh, or the movement destination candidate position and the vertical direction angle of the target sound image.

Thus, by performing the process 2D(1) to the process 2D(4), or the process 3D(1) to the process 3D(6), it can be determined, by simple calculation, whether or not the target sound image is outside a VBAP mesh, and the movement destination position of the target sound image can also be determined.

In particular, a position on a boundary of a mesh can be obtained as the movement destination position of the target sound image, and therefore, the target sound image can be moved to an appropriate position. In other words, a sound image can be localized with higher precision. As a result, a deviation of a sound image position due to movement of a sound image can be minimized, resulting in higher-quality sound.

In addition, in the processes described above, a mesh for which VBAP calculation should be performed for the target sound image, i.e., a mesh that may include the position of the target sound image, can be specified, and therefore, the amount of VBAP calculation in a subsequent step can be significantly reduced.

In VBAP, it cannot be directly determined within which mesh a sound image is present, and therefore, calculation for obtaining coefficients (gains) is performed for all meshes, and a mesh for which none of the obtained coefficients is negative is determined to be a mesh on which a sound image is present.

Therefore, in this case, it is necessary to perform VBAP calculation for all meshes, and therefore, the necessary amount of calculation is huge when there are a large number of meshes.

However, in the present technology, when it is necessary to move the target sound image, identification information indicating a mesh to which a movement destination position that is the destination belongs is output. Therefore, it is necessary to perform VBAP calculation only for that mesh, and therefore, the amount of VBAP calculation can be significantly reduced.

Also, even when it is not necessary to move the target sound image, identification information indicating a mesh that may include the position of the target sound image is output, and therefore, it is not necessary to perform VBAP calculation for those other than such a mesh. Therefore, even in this case, the amount of VBAP calculation can be significantly reduced.

<Example Configuration of Sound Processing Device>

Next, a specific embodiment to which the present technology is applied will be described.

Figure 6:
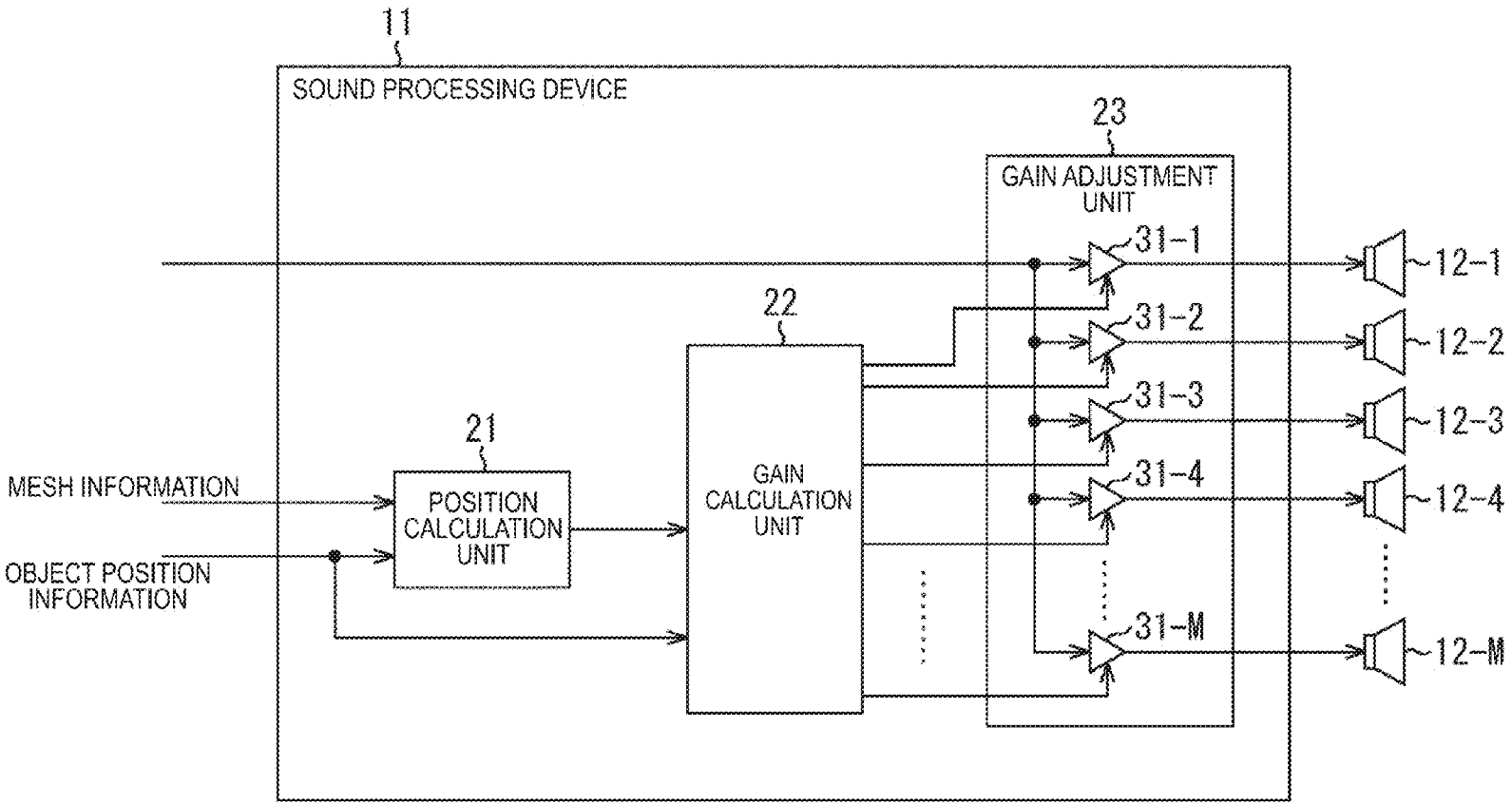
FIG. 6 is a diagram showing an example configuration of a sound processing device.

FIG. 6 is a diagram showing an example configuration of an embodiment of a sound processing device to which the present technology is applied.

The sound processing device 11 performs gain adjustment on a monaural sound signal externally supplied, for each channel, to generate sound signals for M channels, and supplies the sound signals to M loudspeakers 12-1 to 12-M corresponding to the respective channels.

The loudspeaker 12-1 to the loudspeaker 12-M output respective channel sounds based on the sound signals supplied from the sound processing device 11. In other words, the loudspeaker 12-1 to the loudspeaker 12-M are sound output units that are sound sources for outputting the respective channel sounds. Note that, in the description that follows, when it is not particularly necessary to distinguish the loudspeaker 12-1 to the loudspeaker 12-M from each other, the loudspeaker 12-1 to the loudspeaker 12-M are also simply referred to as the loudspeakers 12.

The loudspeakers 12 are placed around a user who views and listens to contents or the like. For example, the loudspeakers 12 are each placed at a position on a surface of a sphere having its center at the position of the user. These M loudspeakers 12 are loudspeakers forming a mesh surrounding the user.

The sound processing device 11 includes a position calculation unit 21, a gain calculation unit 22, and a gain adjustment unit 23.

The sound processing device 11 is supplied with a sound signal of sound captured by a microphone attached to an object, such as, for example, a moving object or the like, position information of the object, and mesh information.

Here, the position information of an object indicates a horizontal direction angle and a vertical direction angle that indicate the sound image position of sound of the object.

Also, the mesh information includes position information about each loudspeaker 12, and information of the loudspeakers 12 forming the mesh. Specifically, the mesh information includes, as the position information about each loudspeaker 12, an index for identifying the loudspeaker 12, and a horizontal direction angle and a vertical direction angle for specifying the position of the loudspeaker 12. Also, the mesh information includes, as the information of the loudspeakers 12 forming the mesh, information for identifying the mesh, and the indexes of the loudspeakers 12 forming the mesh.

The position calculation unit 21 calculates the movement destination position of a sound image of an object based on the supplied object position information and mesh information, and supplies the movement destination position and the identification information of the mesh to the gain calculation unit 22.

The gain calculation unit 22 calculates the gain of each loudspeaker 12 based on the movement destination position and identification information supplied from the position calculation unit 21, and the supplied object position information, and outputs the gain of each loudspeaker 12 to the gain adjustment unit 23.

The gain adjustment unit 23 performs gain adjustment on a sound signal of an object externally supplied, based on each gain supplied from the gain calculation unit 22, and supplies the resultant M channel sound signals to the loudspeakers 12, which then outputs the M channel sound signals.

The gain adjustment unit 23 includes an amplification unit 31-1 to an amplification unit 31-M. The amplification unit 31-1 to the amplification unit 31-M perform gain adjustment on a sound signal externally supplied, based on a gain supplied from the gain calculation unit 22, and supply the resultant sound signals to the loudspeaker 12-1 to the loudspeaker 12-M.

Note that, in the description that follows, when it is not particularly necessary to distinguish the amplification unit 31-1 to the amplification unit 31-M from each other, the amplification unit 31-1 to the amplification unit 31-M are also simply referred to as the amplification units 31.

<Example Configuration of Position Calculation Unit>

Figure 7:
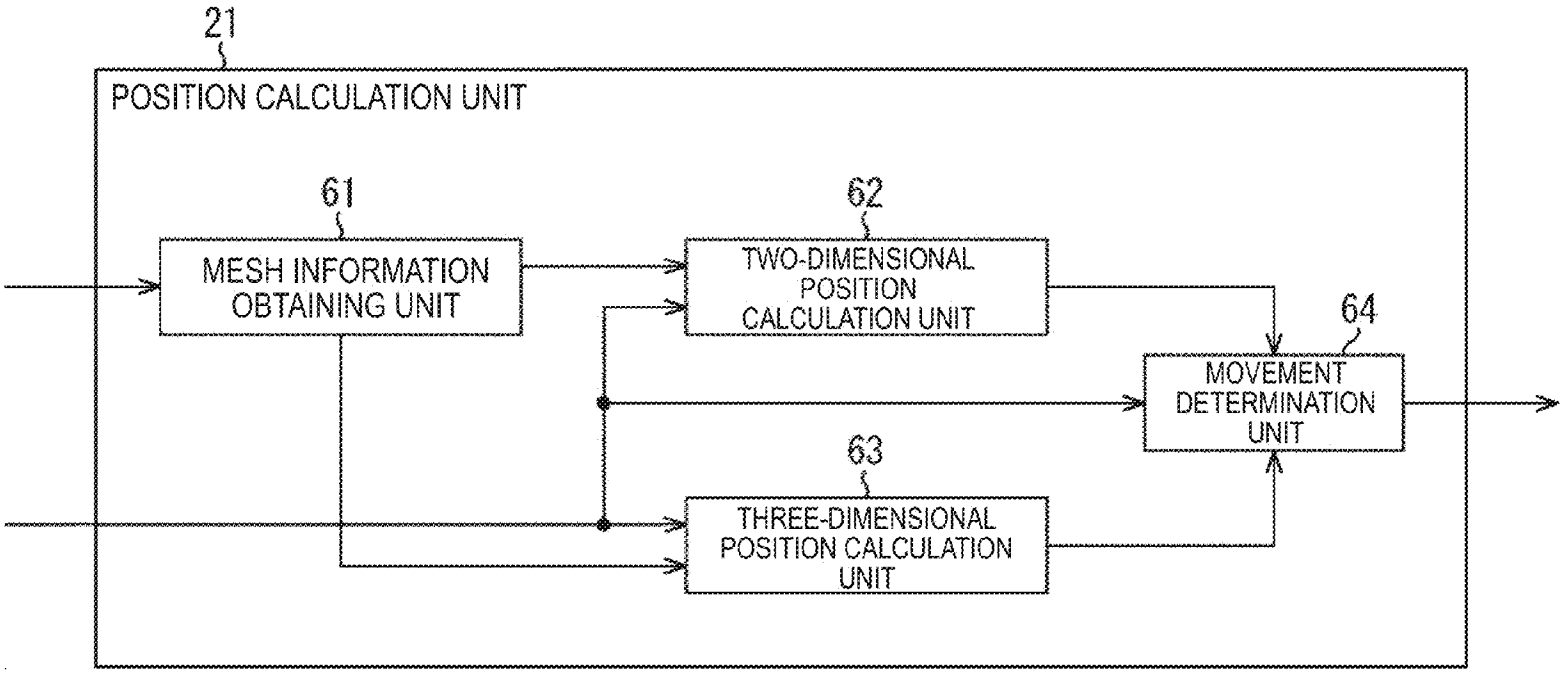
FIG. 7 is a diagram showing a configuration of a position calculation unit.

Also, the position calculation unit 21 in the sound processing device 11 of FIG. 6 is configured as shown in FIG. 7.

The position calculation unit 21 includes a mesh information obtaining unit 61, a two-dimensional position calculation unit 62, a three-dimensional position calculation unit 63, and a movement determination unit 64.

The mesh information obtaining unit 61 externally obtains mesh information, determines whether or not meshes formed by the loudspeakers 12 include a three-dimensional mesh, and based on the determination result, supplies the mesh information to the two-dimensional position calculation unit 62 or the three-dimensional position calculation unit 63. Specifically, the mesh information obtaining unit 61 determines whether the gain calculation unit 22 is to perform two-dimensional VBAP or three-dimensional VBAP.

The two-dimensional position calculation unit 62 performs the process 2D(1) to the process 2D(3) based on the mesh information supplied from the mesh information obtaining unit 61 and object position information externally supplied to calculate the movement destination candidate position of the target sound image, and supplies the movement destination candidate position of the target sound image to the movement determination unit 64.

The three-dimensional position calculation unit 63 performs the process 3D(1) to the process 3D(5) based on the mesh information supplied from the mesh information obtaining unit 61 and object position information externally supplied to calculate the movement destination candidate position of the target sound image, and supplies the movement destination candidate position of the target sound image to the movement determination unit 64.

The movement determination unit 64 calculates the movement destination position of the target sound image based on the movement destination candidate position supplied from the two-dimensional position calculation unit 62 or the movement destination candidate position supplied from the three-dimensional position calculation unit 63, and the object position information supplied, and supplies the movement destination position of the target sound image to the gain calculation unit 22.

<Example Configuration of Two-Dimensional Position Calculation Unit>

Figure 8:
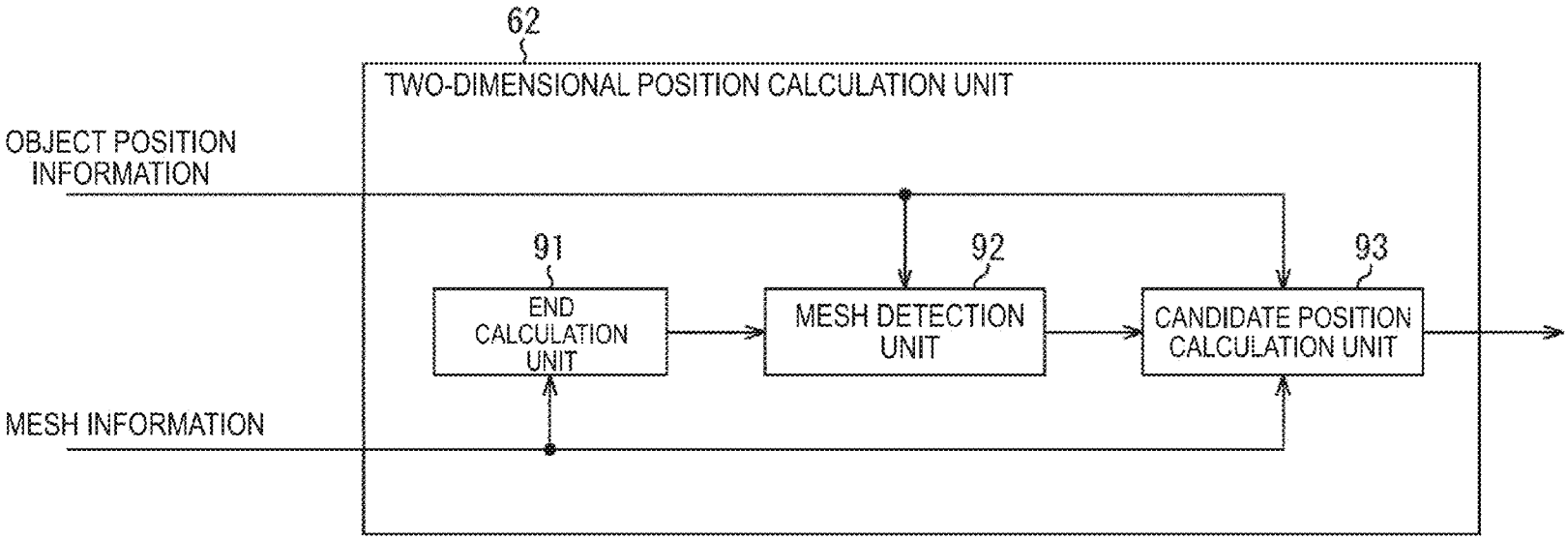
FIG. 8 is a diagram showing a configuration of a two-dimensional position calculation unit.

Moreover, the two-dimensional position calculation unit 62 of FIG. 7 is configured as shown in FIG. 8.

The two-dimensional position calculation unit 62 includes an end calculation unit 91, a mesh detection unit 92, and a candidate position calculation unit 93.

The end calculation unit 91 calculates the left limit value $\theta_{nl}$ and right limit value $\theta_{nr}$ of each mesh based on the mesh information supplied from the mesh information obtaining unit 61, and supplies the left limit value $\theta_{nl}$ and right limit value $\theta_{nr}$ of each mesh to the mesh detection unit 92.

The mesh detection unit 92 detects a mesh including the horizontal direction position of the target sound image based on the object position information supplied, and the left limit value and right limit value supplied from the end calculation unit 91. The mesh detection unit 92 supplies the mesh detection result, and the left limit value and right limit value of the detected mesh, to the candidate position calculation unit 93.

The candidate position calculation unit 93 calculates the movement destination candidate position $\gamma_{nD}$ of the target sound image based on the mesh information supplied from the mesh information obtaining unit 61, the object position information supplied, the detection result from the mesh detection unit 92, the left limit value, and the right limit value, and supplies the movement destination candidate position $\gamma_{nD}$ of the target sound image to the movement determination unit 64. Note that, for example, the candidate position calculation unit 93 may previously calculate and hold the invertible matrix $L_{123}^{-1}$ of a mesh from the position information of the loudspeakers 12 contained in the mesh information.

<Example Configuration of Three-Dimensional Position Calculation Unit>

Figure 9:
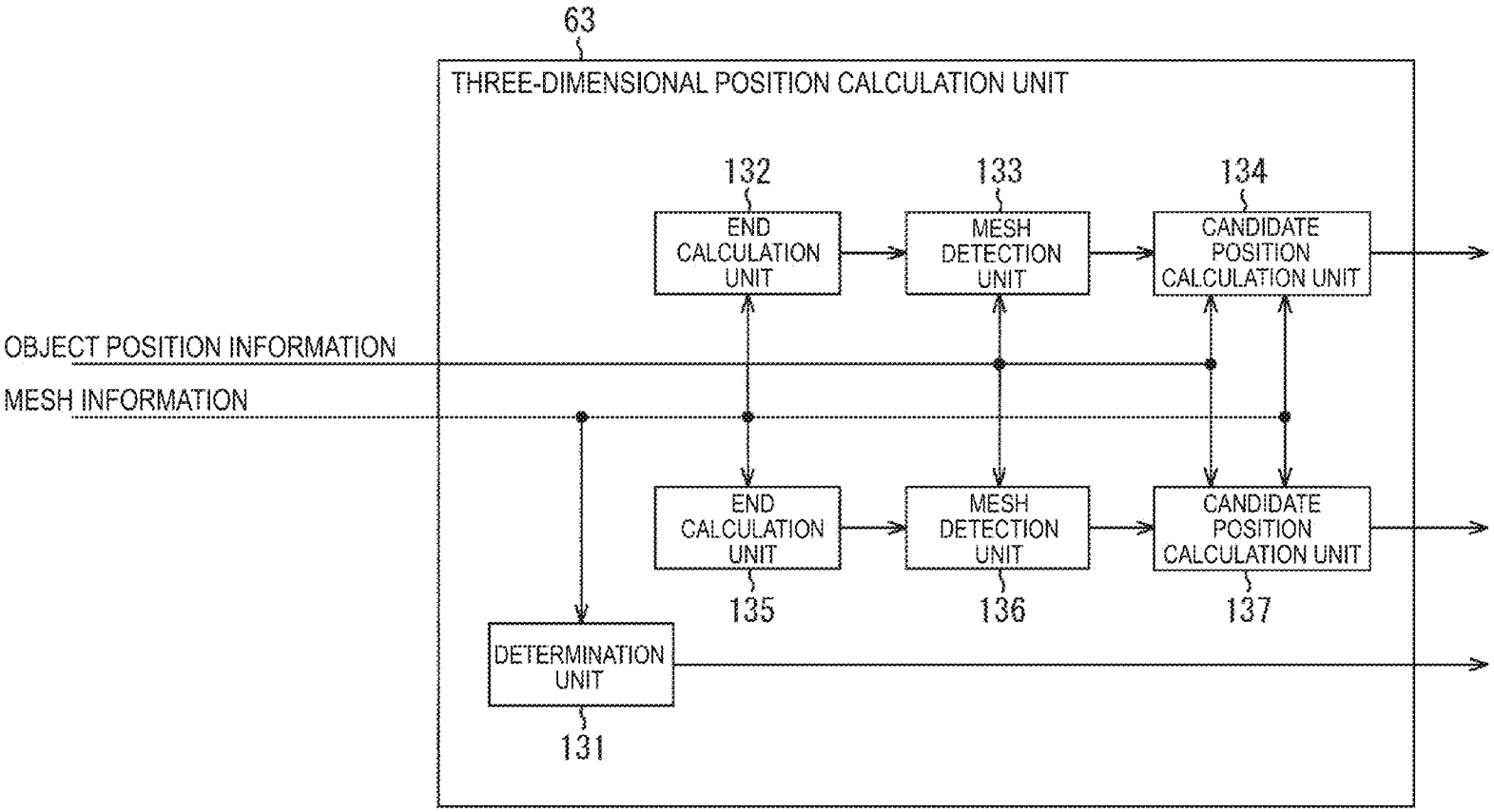
FIG. 9 is a diagram showing a configuration of a three-dimensional position calculation unit.

Also, the three-dimensional position calculation unit 63 of FIG. 7 is configured as shown in FIG. 9.

The three-dimensional position calculation unit 63 includes a determination unit 131, an end calculation unit 132, a mesh detection unit 133, a candidate position calculation unit 134, an end calculation unit 135, a mesh detection unit 136, and a candidate position calculation unit 137.

The determination unit 131 determines whether the loudspeakers 12 includes a top loudspeaker and a bottom loudspeaker, based on the mesh information supplied from the mesh information obtaining unit 61, and supplies the determination result to the movement determination unit 64.

The end calculation unit 132 to the candidate position calculation unit 134 are similar to the end calculation unit 91 to the candidate position calculation unit 93 of FIG. 8, and will not be described.

The end calculation unit 135 calculates the left limit value, right limit value, and intermediate value of each mesh, based on the mesh information supplied from the mesh information obtaining unit 61, and determines whether or not a mesh includes a top position or a bottom position, and supplies the calculation result and the determination result to the mesh detection unit 136.

The mesh detection unit 136 detects a mesh including the horizontal direction position of the target sound image, based on the object position information supplied, and the calculation result and determination result supplied from the end calculation unit 135, specifies an arc in the mesh that is the destination of a sound image, and supplies the arc to the candidate position calculation unit 137.

The candidate position calculation unit 137 calculates the movement destination candidate position $\gamma_{nD}$ of the target sound image based on the mesh information supplied from the mesh information obtaining unit 61, the object position information supplied, and the arc detection result from the mesh detection unit 136, and supplies the movement destination candidate position $\gamma_{nD}$ of the target sound image to the movement determination unit 64. Also, the candidate position calculation unit 137 supplies the determination result of a mesh including a top position or a bottom position, which is supplied from the mesh detection unit 136, to the movement determination unit 64. Note that, for example, the candidate position calculation unit 137 may previously calculate and hold the invertible matrix $L_{123}^{-1}$ from the position information of the loudspeakers 12 contained in the mesh information.

<Description of Sound Image Localization Control Process>

Incidentally, when the sound processing device 11 is supplied with mesh information, object position information, and a sound signal, and instructed to output an object sound, the sound processing device 11 begins a sound image localization control process to cause the object sound to be output so that the sound image is to be localized at an appropriate position.

The sound image localization control process by the sound processing device 11 will now be described with reference to a flowchart of FIG. 10.

In step S11, the mesh information obtaining unit 61 determines whether or not VBAP calculation that is to be performed in the gain calculation unit 22 in a subsequent step is two-dimensional VBAP, based on mesh information externally supplied, and supplies the mesh information to the two-dimensional position calculation unit 62 or the three-dimensional position calculation unit 63, depending on the determination result. For example, if the mesh information contains at least one piece of information of loudspeakers 12 forming a mesh, that includes the indexes of three loudspeakers 12, it is determined that the VBAP calculation is not two-dimensional VBAP.

If, in step S11, it is determined that the VBAP calculation is two-dimensional VBAP, the position calculation unit 21 performs, in step S12, a movement destination position calculation process in two-dimensional VBAP, and supplies the movement destination position and the identification information of a mesh to the gain calculation unit 22, and control proceeds to step S14. Note that the movement destination position calculation process in two-dimensional VBAP will be described in detail below.

Also, if, in step S11, it is determined that the VBAP calculation is not two-dimensional VBAP, i.e., it is determined that the VBAP calculation is three-dimensional VBAP, control proceeds to step S13.

In step S13, the position calculation unit 21 performs a movement destination position calculation process in three-dimensional VBAP, and supplies the movement destination position and the identification information of a mesh to the gain calculation unit 22, and control proceeds to step S14. Note that the movement destination position calculation process in three-dimensional VBAP will be described in detail below.

After the movement destination position has been obtained in step S12 or step S13, the process of step S14 is performed.

In step S14, the gain calculation unit 22 calculates a gain of each loudspeaker 12 and supplies the calculated gain to the gain adjustment unit 23, based on the movement destination position and identification information supplied from the position calculation unit 21, and object position information supplied.

Specifically, the gain calculation unit 22 assumes that a position determined by the horizontal direction angle $\theta$ of a sound image contained in the object position information, and a vertical direction angle that is a movement destination position supplied from the position calculation unit 21, is the position of a vector p at a position where a sound image of sound is to be localized. Thereafter, the gain calculation unit 22 calculates Formula (1) or Formula (3) for a mesh indicated by the mesh identification information using the vector p to obtain the gains (coefficients) of two or three loudspeakers 12 forming the mesh.

Also, the gain calculation unit 22 sets the gains of those other than the loudspeakers 12 forming the mesh indicated by the identification information to zero.

Note that when it is not necessary to move the target sound image, the movement destination position of the target sound image is not calculated, and the gain calculation unit 22 is supplied with the identification information of a mesh that may include the position of the target sound image. In such a case, the gain calculation unit 22 assumes that a position that is determined by the horizontal direction angle θ and vertical direction angle γ of a sound image contained in the object position information is the position of a vector p that is a position where a sound image of sound is to be localized. Thereafter, the gain calculation unit 22 calculates Formula (1) or Formula (3) for a mesh indicated by the mesh identification information using the vector p, to obtain the gains (coefficients) of two or three loudspeakers 12 forming the mesh.

Moreover, the gain calculation unit 22 selects a mesh for which none of the gains is negative from meshes for which gains have been calculated, assumes that the gains of loudspeakers 12 forming the selected mesh are gains obtained by VBAP, and sets the gains of the other loudspeakers 12 to zero.

As a result, the gain of each loudspeaker 12 can be obtained by small calculation. Note that the invertible matrix of a mesh used in VBAP calculation in the gain calculation unit 22 may be obtained from the candidate position calculation unit 93 or the candidate position calculation unit 137 and held. This will reduce the amount of calculation, and therefore, allow the process result to be more quickly obtained.

In step S15, the amplification unit 31 of the gain adjustment unit 23 performs gain adjustment on a sound signal of an object externally supplied, based on the gains supplied from the gain calculation unit 22, and supplies the resultant sound signal to the loudspeakers 12, and causes the loudspeakers 12 to output sound.

Each loudspeaker 12 outputs sound based on a sound signal supplied from the amplification unit 31. As a result, a sound image can be localized at a target position. When the loudspeakers 12 output sound, the sound image localization control process is ended.

Thus, the sound processing device 11 calculates the movement destination position of the target sound image, and calculates the gain of each loudspeaker 12 corresponding to the calculation result to perform gain adjustment on a sound signal. As a result, a sound image can be localized at a target position, resulting in higher-quality sound.

<Description of Movement Destination Position Calculation Process in Two-Dimensional VBAP>

Next, the movement destination position calculation process in two-dimensional VBAP corresponding to the process of step S12 of FIG. 10 will be described with reference to a flowchart of FIG. 11.

In step S41, the end calculation unit 91 calculates the left limit value $\theta_{nl}$ and right limit value $\theta_{nr}$ of each mesh, based on the mesh information supplied from the mesh information obtaining unit 61, and supplies the left limit value $\theta_{nl}$ and right limit value $\theta_{nr}$ of each mesh to the mesh detection unit 92. Specifically, the above process 2D(1) is performed to obtain a left limit value and a right limit value by Formula (8) for each of N meshes.

In step S42, the mesh detection unit 92 detects a mesh including the horizontal direction position of the target sound image, based on object position information supplied, and the left limit value and right limit value supplied from the end calculation unit 91.

Specifically, the mesh detection unit 92 performs the above process 2D(2) to detect a mesh including the horizontal direction position of the target sound image by calculation of Formula (9), and supplies the mesh detection result, and the left limit value and right limit value of the detected mesh, to the candidate position calculation unit 93.

In step S43, the candidate position calculation unit 93 calculates the movement destination candidate position $\gamma_{nD}$ of the target sound image, based on the mesh information from the mesh information obtaining unit 61, the object position information supplied, the detection result from the mesh detection unit 92, the left limit value, and the right limit value, and supplies the movement destination candidate position $\gamma_{nD}$ of the target sound image to the movement determination unit 64. In other words, the above process 2D(3) is performed.

In step S44, the movement determination unit 64 determines whether or not it is necessary to move the target sound image, based on the movement destination candidate position supplied from the candidate position calculation unit 93, and the object position information supplied.

In other words, the above process 2D(4) is performed. Specifically, from the movement destination candidate positions $\gamma_{nD}$, one that has a vertical direction angle closest to the vertical direction angle γ of the target sound image, and if the movement destination candidate position $\gamma_{nD}$ obtained by the detection matches the vertical direction angle γ of the target sound image, determines that it is not necessary to move the target sound image.

If, in step S44, it is determined that it is necessary to move the target sound image, the movement determination unit 64 outputs the movement destination position of the target sound image, and the mesh identification information, to the gain calculation unit 22 in step S45, and the movement destination position calculation process in two-dimensional VBAP is ended. After the movement destination position calculation process in two-dimensional VBAP is ended, control proceeds to step S14 of FIG. 10.

For example, a movement destination candidate position $\gamma_{nD}$ closest to the vertical direction angle γ of the target sound image is determined to be a movement destination position, and the movement destination position, and the identification information of a mesh for which the movement destination position has been calculated, are output.

On the other hand, if, in step S44, it is determined that it is not necessary to move the target sound image, the movement determination unit 64 outputs the identification information of a mesh for which the movement destination candidate position $\gamma_{nD}$ has been calculated to the gain calculation unit 22 in step S46, and the movement destination position calculation process in two-dimensional VBAP is ended. In other words, the identification information of all meshes that it has been determined include the horizontal direction position of the target sound image, is output. After the movement destination position calculation process in two-dimensional VBAP is ended, control proceeds to step S14 of FIG. 10.

Thus, the position calculation unit 21 detects a mesh including the position of the target sound image in the horizontal direction, and determines a movement destination position which is the destination of the target sound image, based on the position information of the mesh and the horizontal direction angle θ of the target sound image.

As a result, it can be determined whether or not the target sound image is outside a mesh, by a small amount of calculation, and an appropriate movement destination position of the target sound image can be calculated with high precision. As a result, a deviation of a sound image position due to movement of a sound image can be minimized, and therefore, higher-quality sound can be obtained. In particular, the position calculation unit 21 can calculate a position on a boundary of a mesh closest to the position of the target sound image in the vertical direction, as a movement destination position, and therefore, a deviation of the sound image position due to movement of a sound image can be minimized.

<Description of Movement Destination Position Calculation Process in Three-Dimensional VBAP>

Next, the movement destination position calculation process in three-dimensional VBAP corresponding to the process of step S13 of FIG. 10 will be described with reference to a flowchart of FIG. 12.

In step S71, the determination unit 131 determines whether the loudspeakers 12 includes a top loudspeaker and a bottom loudspeaker, based on the mesh information supplied from the mesh information obtaining unit 61, and supplies the determination result to the movement determination unit 64. In other words, the above process 3D(1) is performed.

In step S72, the three-dimensional position calculation unit 63 performs a movement destination candidate position calculation process for a two-dimensional mesh, to calculate a movement destination candidate position for a two-dimensional mesh, and supplies the calculation result to the movement determination unit 64. Specifically, for a two-dimensional mesh, the above process 3D(2) to process 3D(5) are performed. Note that the movement destination candidate position calculation process for a two-dimensional mesh will be described in detail below.

In step S73, the three-dimensional position calculation unit 63 performs a movement destination candidate position calculation process for a three-dimensional mesh, to calculate a movement destination candidate position for a three-dimensional mesh, and supplies the calculation result to the movement determination unit 64. Specifically, for a three-dimensional mesh, the above process 3D(2) to process 3D(5) are performed. Note that the movement destination candidate position calculation process for a three-dimensional mesh will be described in detail below.

In step S74, the movement determination unit 64 determines whether or not it is necessary to move the target sound image, based on the movement destination candidate position supplied from the three-dimensional position calculation unit 63, the object position information supplied, the determination result from the determination unit 131, and the information of a mesh including a top position or a bottom position that is supplied from the mesh detection unit 136 through the candidate position calculation unit 137. Specifically, the above process 3D(6) is performed.

If, in step S74, it is determined that it is necessary to move the target sound image, the movement determination unit 64 outputs the movement destination position of the target sound image, and the mesh identification information, to the gain calculation unit 22 in step S75, and the movement destination position calculation process in three-dimensional VBAP is ended. After the movement destination position calculation process in three-dimensional VBAP is ended, control proceeds to step S14 of FIG. 10.

On the other hand, if, in step S74, it is determined that it is not necessary to move the target sound image, the movement determination unit 64 outputs the identification information of a mesh for which the movement destination candidate position $\gamma_{nD}$ has been calculated to the gain calculation unit 22 in step S76, and the movement destination position calculation process in three-dimensional VBAP is ended. In other words, the identification information of all meshes that it has been determined include the horizontal direction position of the target sound image, is output. After the movement destination position calculation process in three-dimensional VBAP is ended, control proceeds to step S14 of FIG. 10.

Thus, the position calculation unit 21 detects a mesh including the position of the target sound image in the horizontal direction, and based on the position information of the mesh and the horizontal direction angle θ of the target sound image, calculates a movement destination position that is the destination of the target sound image. As a result, it can be determined whether or not the target sound image is outside the mesh, by a small amount of calculation, and an appropriate movement destination position of the target sound image can be calculated with high precision.

<Description of Movement Destination Candidate Position Calculation Process for Two-Dimensional Mesh>

Next, the movement destination candidate position calculation process for a two-dimensional mesh corresponding to the process of step S72 of FIG. 12 will be described with reference to a flowchart of FIG. 13.

In step S111, the end calculation unit 132 calculates the left limit value $\theta_{nl}$ and right limit value $\theta_{nr}$ of each mesh, based on the mesh information supplied from the mesh information obtaining unit 61, and supplies the left limit value $\theta_{nl}$ and right limit value $\theta_{nr}$ of each mesh to the mesh detection unit 133. Specifically, the above process 3D(2.1)-2 is performed to obtain a left limit value and a right limit value by Formula (8) for each of N meshes.

In step S112, the mesh detection unit 133 detects a mesh including the horizontal direction position of the target sound image, based on the object position information supplied, and the left limit value and right limit value supplied from the end calculation unit 132. Specifically, the above process 3D(3) is performed.

In step S113, the mesh detection unit 133 specifies an arc that is a movement target of the target sound image for each mesh including the horizontal direction position of the target sound image, that has been detected in step S112. Specifically, the mesh detection unit 133 assumes that an arc that is a boundary line of a two-dimensional mesh detected in step S112 is directly an arc that is a movement target.

The mesh detection unit 133 supplies the detection result of a mesh including the horizontal direction position of the target sound image, and the left limit value and right limit value of the detected mesh, to the candidate position calculation unit 134.

In step S114, the candidate position calculation unit 134 calculates the movement destination candidate position $\gamma_{nD}$ of the target sound image, based on the mesh information from the mesh information obtaining unit 61, the object position information supplied, the detection result from the mesh detection unit 133, the left limit value, and the right limit value, and supplies the movement destination candidate position $\gamma_{nD}$ of the target sound image to the movement determination unit 64. In other words, the above process 3D(5)-2 is performed.

Figure 12:
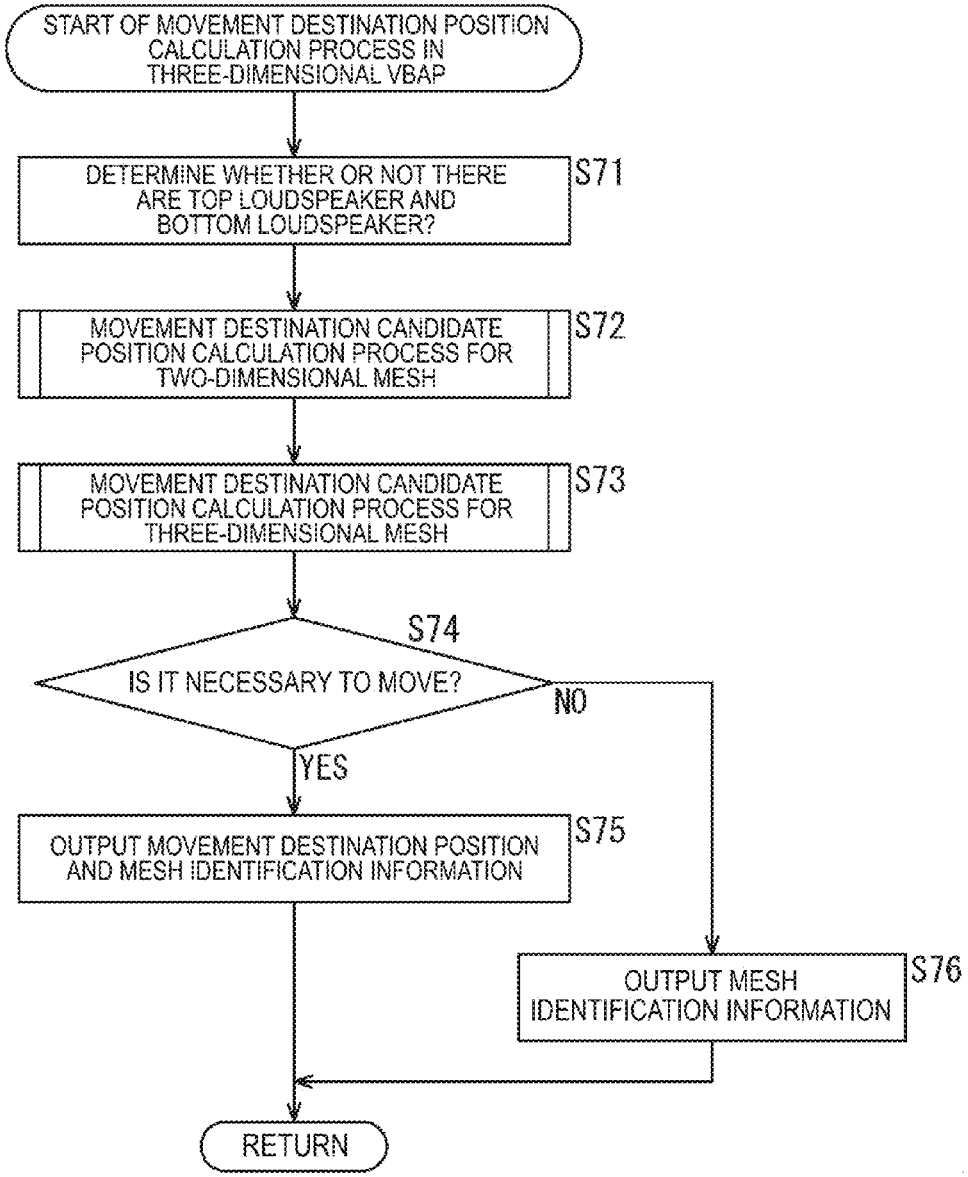
FIG. 12 is a flowchart for describing a movement destination position calculation process in three-dimensional VBAP.
Figure 13:
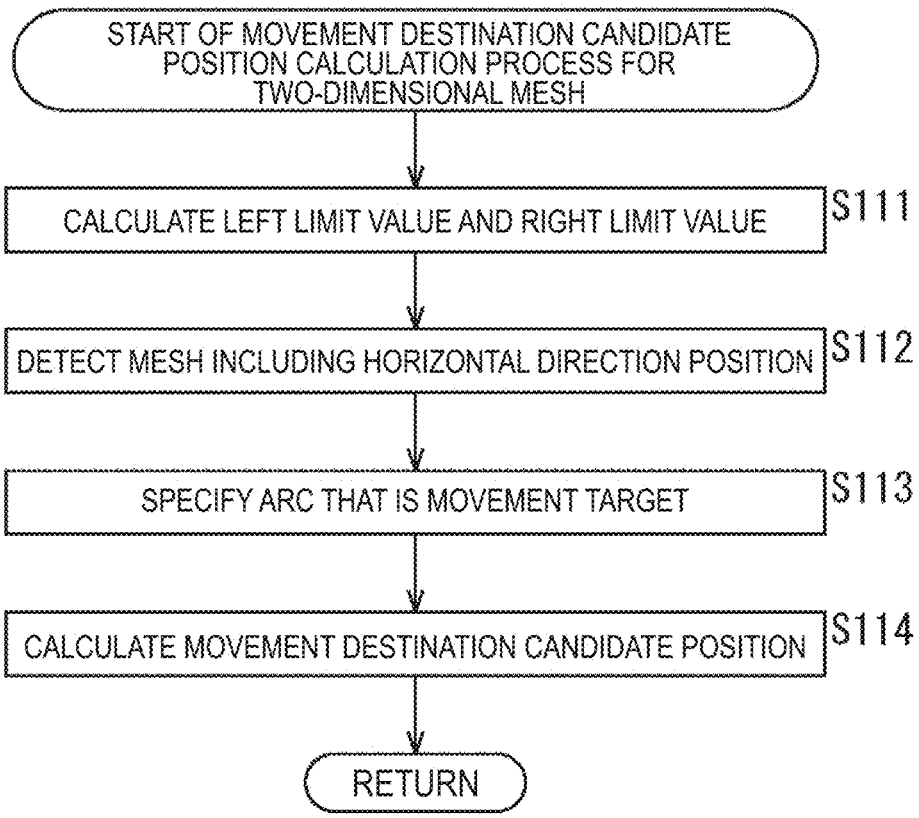
FIG. 13 is a flowchart for describing a movement destination candidate position calculation process for a two-dimensional mesh.

After the movement destination candidate position of the target sound image has been calculated, the movement destination candidate position calculation process for a two-dimensional mesh is ended, and thereafter, control proceeds to step S73 of FIG. 12.

Thus, the three-dimensional position calculation unit 63 detects a two-dimensional mesh including the position of the target sound image in the horizontal direction, and based on the position information of the two-dimensional mesh and the horizontal direction angle θ of the target sound image, calculates a movement destination candidate position that is the destination of the target sound image. As a result, an appropriate destination of the target sound image can be calculated with higher precision by simple calculation.

<Description of Movement Destination Candidate Position Calculation Process for Three-Dimensional Mesh>

Figure 14:
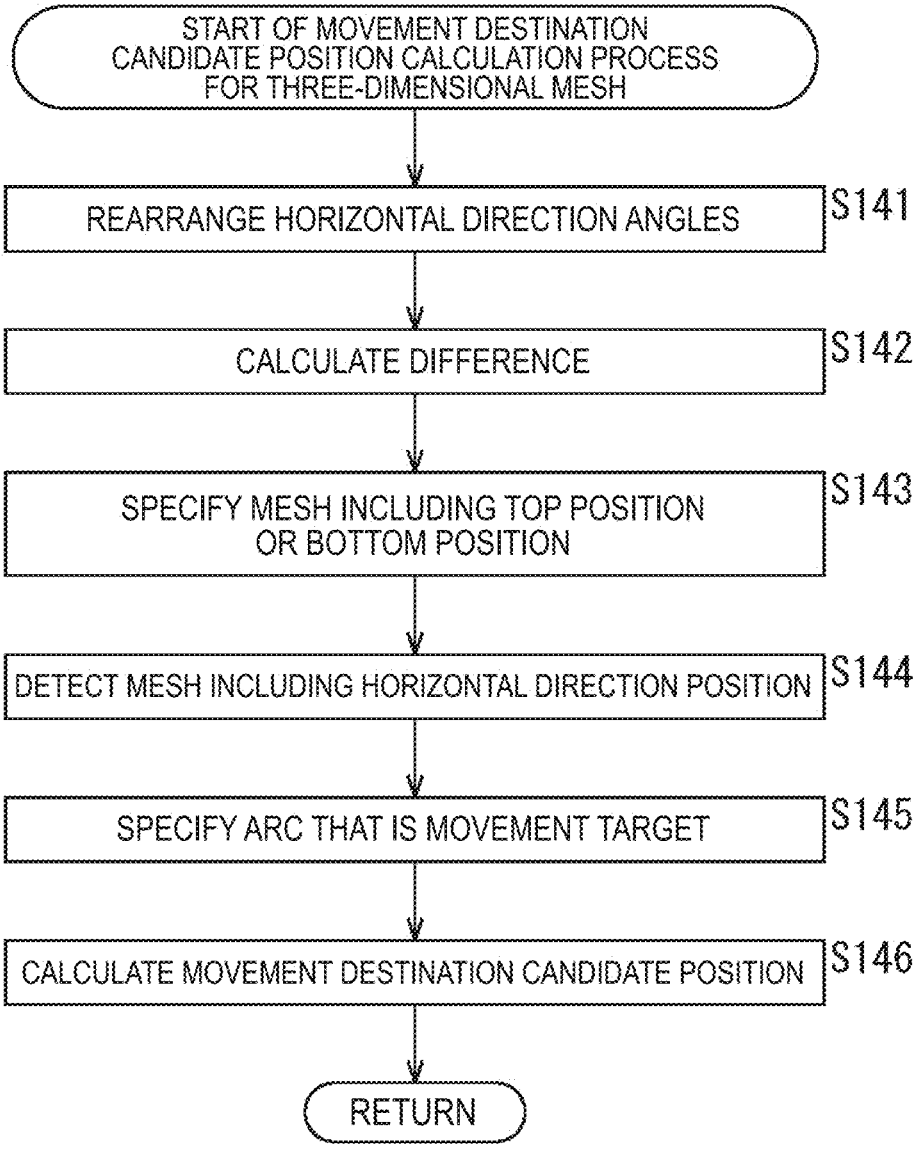
FIG. 14 is a flowchart for describing a movement destination candidate position calculation process for a three-dimensional mesh.

Next, the movement destination candidate position calculation process for a three-dimensional mesh corresponding to the process of step S73 of FIG. 12 will be described with reference to a flowchart of FIG. 14.

In step S141, the end calculation unit 135 rearranges the horizontal direction angles of three loudspeakers forming a mesh, based on the mesh information supplied from the mesh information obtaining unit 61. Specifically, the above process 3D(2.1)-1 is performed.

In step S142, the end calculation unit 135 calculates differences between horizontal direction angles based on the rearranged horizontal direction angles. Specifically, the above process 3D(2.2)-1 is performed.

In step S143, the end calculation unit 135 specifies a mesh including a top position or a bottom position based on the calculated differences, and calculates the left limit value, right limit value, and intermediate value of a mesh that does not include a top position or a bottom position. Specifically, the above process 3D(2.3)-1 and process 3D(2.4)-1 are performed.

The end calculation unit 135 supplies the determination result of a mesh including a top position or a bottom position, and the horizontal direction angle $\theta_{nlow1}$ to horizontal direction angle $\theta_{nlow3}$ of the mesh including a top position or a bottom position, to the mesh detection unit 136. Also, the end calculation unit 135 supplies the left limit value, right limit value, and intermediate value of a mesh that does not include a top position or a bottom position, to the mesh detection unit 136.

In step S144, the mesh detection unit 136 detects a mesh including the horizontal direction position of the target sound image, based on the object position information supplied, and the calculation result and determination result supplied from the end calculation unit 135. Specifically, the above process 3D(3) is performed.

In step S145, the mesh detection unit 136 specifies an arc that is the movement target of the target sound image, based on the object position information supplied, the left limit value, right limit value, and intermediate value of a mesh supplied from the end calculation unit 135, the horizontal direction angle $\theta_{nlow1}$ to horizontal direction angle $\theta_{nlow3}$ of the mesh, and the determination result. Specifically, the above process 3D(4) is performed.

The mesh detection unit 136 supplies the determination result of an arc that is a movement target, i.e., the determination result of a loudspeaker having a coefficient of zero, to the candidate position calculation unit 137, and supplies the determination result of a mesh including a top position or a bottom position to the movement determination unit 64 through the candidate position calculation unit 137.

In step S146, the candidate position calculation unit 137 calculates the movement destination candidate position $\gamma_{nD}$ of the target sound image, based on the mesh information from the mesh information obtaining unit 61, the object position information supplied, and the determination result of an arc from the mesh detection unit 136, and supplies the movement destination candidate position $\gamma_{nD}$ of the target sound image to the movement determination unit 64. Specifically, the above process 3D(5)-1 is performed.

After the movement destination candidate position of the target sound image has been calculated, the movement destination candidate position calculation process for a three-dimensional mesh is ended, and thereafter, control proceeds to step S74 of FIG. 12.

Thus, the three-dimensional position calculation unit 63 detects a three-dimensional mesh including the position of the target sound image in the horizontal direction, and based on the position information of the three-dimensional mesh and the horizontal direction angle θ of the target sound image, calculates a movement destination candidate position that is the destination of the target sound image. As a result, an appropriate destination of the target sound image can be calculated with higher precision by simple calculation.

Variation 1 of First Embodiment

<Whether or not it is Necessary to Move Sound Image and Calculation of Movement Destination Position>

Note that, in the foregoing, a case has been described in which even when a three-dimensional mesh and a two-dimensional mesh coexist, only one of the movement destination candidate position $\gamma_{nD}$ of the three-dimensional mesh and the movement destination candidate position $\gamma_{nD}$ of the two-dimensional mesh is obtained. However, for some mesh arrangements, both the movement destination candidate position $\gamma_{nD}$ of a three-dimensional mesh and the movement destination candidate position $\gamma_{nD}$ of a two-dimensional mesh may be obtained.

In such a case, the movement determination unit 64 performs a process shown in FIG. 15 to determine whether or not it is necessary to move the target sound image, and to calculate a movement destination position.

Specifically, the movement determination unit 64 compares the movement destination candidate position $\gamma_{nD}$ of a two-dimensional mesh with the movement destination candidate position $\gamma_{nD_max}$ of a three-dimensional mesh. Thereafter, if $\gamma_{nD}>\gamma_{nD_max}$ is established, the movement determination unit 64 further determines whether or not the vertical direction angle γ of the target sound image is greater than the movement destination candidate position $\gamma_{nD_max}$. Specifically, it is determined whether or not $\gamma>\gamma_{nD_max}$ is established.

Here, if $\gamma>\gamma_{nD_max}$ is established, the target sound image is moved to the closer one of the movement destination candidate position $\gamma_{nD}$ of the two-dimensional mesh and the movement destination candidate position $\gamma_{nD_max}$.

Therefore, if $|\gamma-\gamma_{nD_max}|<|\gamma-\gamma_{nD}|$ is established, the movement determination unit 64 determines that the movement destination candidate position $\gamma_{nD_max}$ is the final movement destination position of the target sound image. Conversely, if $|\gamma-\gamma_{nD_max}|<|\gamma-\gamma_{nD}|$ is not established, the movement determination unit 64 determines that the movement destination candidate position $\gamma_{nD}$ of the two-dimensional mesh is the final movement destination position of the target sound image.

Also, if $\gamma_{nD}>\gamma_{nD_max}$ is established and $\gamma>\gamma_{nD_max}$ is not established, and the vertical direction angle γ of the target sound image is smaller than the movement destination candidate position $\gamma_{nD_min}$, i.e., $\gamma<\gamma_{nD_min}$, the movement determination unit 64 determines that the movement destination candidate position $\gamma_{nD_min}$ is final the fin movement destination position of the target sound image.

Moreover, if $\gamma_{nD}<\gamma_{nD_min}$ is established, the movement determination unit 64 compares the vertical direction angle $\gamma$ of the target sound image with the movement destination candidate position $\gamma_{nD_min}$.

Here, if $\gamma<\gamma_{nD_min}$ is established, the target sound image is moved to the closer one of the movement destination candidate position $\gamma_{nD}$ of the two-dimensional mesh and the movement destination candidate position $\gamma_{nD_min}$.

Therefore, if $\gamma<\gamma_{nD_min}$ is established, the movement determination unit 64 further determines whether or not $|\gamma-\gamma_{nD_min}|<|\gamma-\gamma_{nD}|$ is established.

Thereafter, if $|\gamma-\gamma_{nD_min}|<|\gamma-\gamma_{nD}|$, the movement determination unit 64 determines that the movement destination candidate position $\gamma_{nD_min}$ is the final movement destination position of the target sound image. Conversely, if $\gamma-\gamma_{nD_min}|<|\gamma-\gamma_{nD}|$ is not established, the movement determination unit 64 determines that the movement destination candidate position $\gamma_{nD}$ of a two-dimensional mesh is the final movement destination position of the target sound image.

Also, if $\gamma_{nD}<\gamma_{nD_min}$ is established, $\gamma<\gamma_{nD_min}$ is not established, and $\gamma>\gamma_{nD_max}$ is established, the movement determination unit 64 determines that the movement destination candidate position $\gamma_{nD_max}$ is final the fin movement destination position of the target sound image.

Moreover, if none of the above cases is established, the movement determination unit 64 determines the final movement destination position of the target sound image according to the above process 3D(6).

Second Embodiment

<Example Configuration of Position Calculation Unit>

Also, in the embodiment described above, each time the position of a sound image to be localized changes, it is necessary to determine whether or not it is necessary to move the sound image, calculate a movement destination position, and perform subsequent VBAP calculation. However, if there are a finite number (discrete value) of possible values of the horizontal direction angle of a sound image, these calculations are highly likely to be redundant, and therefore, it can be said that a large amount of unnecessary calculation occurs.

Therefore, when there are a finite number (discrete) of possible values of the horizontal direction angle of a sound image, a movement destination candidate position in a case where it is necessary to move the target sound image is previously calculated for all of these values, and the movement destination candidate positions may be recorded in association with the respective horizontal direction angles $\theta$. In this case, for example, the movement destination candidate position $\gamma_{nD}$ of a two-dimensional mesh, the movement destination candidate position $\gamma_{nD_max}$ and movement destination candidate position $\gamma_{nD_min}$ of a three-dimensional mesh, are recorded in a memory in association with the horizontal direction angle $\theta$.

As a result, when a sound image is to be actually localized by VBAP, a movement destination candidate position stored in a memory is compared with the vertical direction angle $\gamma$ of the target sound image. Therefore, it is not necessary to perform calculation for determining whether or not it is necessary to move a sound image, resulting in a significant reduction in the amount of calculation.

Moreover, in this case, if the gain of each loudspeaker 12 calculated in VBAP when it is necessary to move a sound image is recorded in a memory, and the identification information of a mesh for which it is necessary to perform gain calculation in VBAP when it is not necessary to move a sound image is recorded in a memory, the amount of calculation can be further reduced.

In this case, for each horizontal direction angle $\theta$, the coefficient (gain) of VBAP for each of the movement destination candidate position $\gamma_{nD}$ of a two-dimensional mesh, and the movement destination candidate position $\gamma_{nD_max}$ and movement destination candidate position $\gamma_{nD_min}$ of a three-dimensional mesh, is recorded in a memory. Also, for each horizontal direction angle $\theta$, the identification information of one or more meshes for which it is necessary to perform gain calculation in VBAP, is recorded in a memory.

Figure 16:
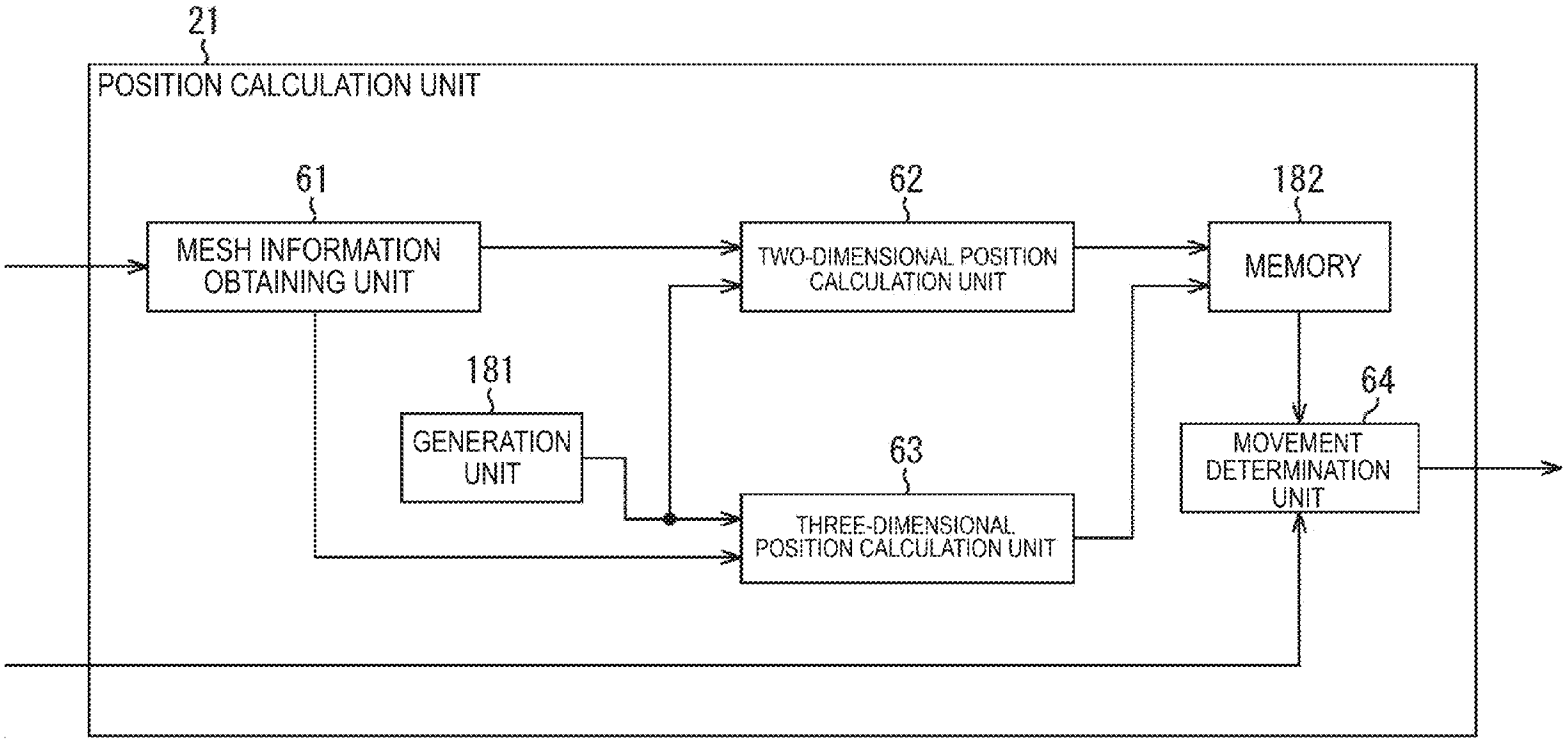
FIG. 16 is a diagram showing another configuration of the position calculation unit.

Thus, when movement destination candidate positions are recorded in association with horizontal direction angles $\theta$, the position calculation unit 21 is configured as shown in, for example, FIG. 16. Note that, in FIG. 16, parts corresponding to those in the case of FIG. 7 are indicated by the same reference characters, and will not be redundantly described.

The position calculation unit 21 shown in FIG. 16 includes a mesh information obtaining unit 61, a two-dimensional position calculation unit 62, a three-dimensional position calculation unit 63, a movement determination unit 64, a generation unit 181, and a memory 182.

The generation unit 181 generates all possible values of the horizontal direction angle $\theta$ in order, and supplies the generated horizontal direction angles to the two-dimensional position calculation unit 62 and the three-dimensional position calculation unit 63.

The two-dimensional position calculation unit 62 and the three-dimensional position calculation unit 63 calculates a movement destination candidate position based on the mesh information supplied from the mesh information obtaining unit 61 for each horizontal direction angle supplied from the generation unit 181, and supplies the movement destination candidate position to the memory 182, which then records the movement destination candidate position.

At this time, the memory 182 is supplied with the movement destination candidate position $\gamma_{nD}$ of a two-dimensional mesh in a case where it is necessary to move a sound image, and the movement destination candidate position $\gamma_{nD_max}$ and movement destination candidate position $\gamma_{nd_min}$ of a three-dimensional mesh.

The memory 182 records the movement destination candidate position for each horizontal direction angle $\theta$ supplied from the two-dimensional position calculation unit 62 and the three-dimensional position calculation unit 63, and optionally supplies the movement destination candidate position to the movement determination unit 64.

Also, the movement determination unit 64, when externally receiving object position information, determines whether or not it is necessary to move a sound image, and calculates and outputs the movement destination position of the sound image to the gain calculation unit 22, by referring to the movement destination candidate positions corresponding to the horizontal direction angles $\theta$ of the object sound image recorded in the memory 182. Specifically, the vertical direction angle $\gamma$ of the target sound image is compared with the movement destination candidate positions recorded in the memory 182 so that it is determined whether or not it is necessary to move a sound image, and optionally, a movement destination candidate position recorded in the memory 182 is determined to be a movement destination position.

Third Embodiment

<Changing of Gain>

Note that, in the above first embodiment or second embodiment, when it is determined that it is necessary to move a sound image, then if a gain is further changed, depending on the degree of movement of the sound image, a deviation between an actual reproduction position of the sound image due to the movement of the sound image, and a sound image position originally intended for reproduction, can be reduced.

For example, the movement determination unit 64, when determining that it is necessary to move a sound image, calculates a difference $D_{move}$ between the vertical direction angle $\gamma_{nD}$ of a movement destination position and the original vertical direction angle $\gamma$ of the target sound image before movement, using the following formula (15), and supplies the difference $D_{move}$ to the gain calculation unit 22.

[Math 15]

$$D_{move}=|\gamma-\gamma_{nD}| \tag{15}$$

The gain calculation unit 22 changes a reproduction gain of a sound image, depending on the difference $D_{move}$ supplied from the movement determination unit 64. Specifically, the gain calculation unit 22 multiplies one of the coefficients (gains) of the loudspeakers 12 calculated by VBAP that is of a loudspeaker 12 that is at opposite ends of an arc of a mesh on which the movement destination position of a sound image is present, by a value depending on the difference $D_{move}$, to further adjust the gain.

If the gain is thus changed, depending on the difference in the position of a sound image between before and after movement, e.g., if the gain is reduced when the difference $D_{move}$ is large, the user can feel as if the sound image were at a position far away from the mesh, for example. Also, if the gain is not substantially changed when the difference $D_{move}$ is small, the user can feel as if the sound image were at a position close to the mesh.

Note that when a sound image is moved in the horizontal direction as well as in the vertical direction, the difference $D_{move}$ may be calculated using the following formula (16).

[Math 16]

$$D_{move}=\arccos(\cos\theta\times\cos\theta_{nD}\times\cos(\gamma-\gamma_{nD})+\sin\theta\times\sin\theta_{nD}) \tag{16}$$

Note that, in Formula (16), $\gamma_{nD}$ and $\theta_{nD}$ indicate the vertical direction angle and horizontal direction angle, respectively, of a destination of a sound image.

An example in which the gain is thus adjusted based on a difference in the position of the target sound image between before and after movement (hereinafter referred to as a movement distance) will now be described in detail.

Figure 17:
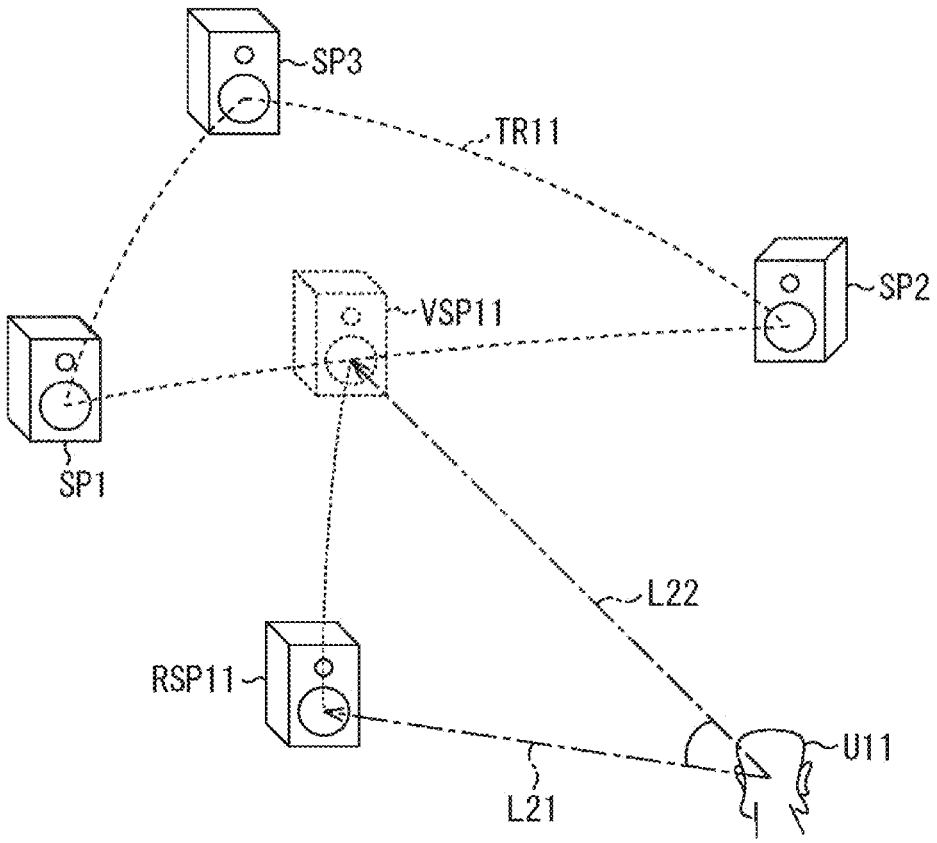
FIG. 17 is a diagram for describing a movement distance of a target sound image.

For example, as shown in FIG. 17, it is assumed that when a sound image at a sound image position RSP11 to be reproduced is moved into a region TR11 as a mesh surrounding a loudspeaker SP1 to a loudspeaker SP3, the position of the destination is a sound image position VSP11 on a boundary of the region TR11. Note that, in FIG. 17, parts corresponding to those in the case of FIG. 4 are indicated by the same reference characters, and will not be redundantly described.

In this case, it is assumed that a distance $r=r_s$ from a user U11 to the original sound image position RSP11 is the same as a distance $r=r_t$ from the user Ulf to the sound image position VSP11 as the destination. In such a case, a distance between the sound image position RSP11 and the sound image position VSP11, i.e., the amount of a movement of the target sound image, can be represented by the length of an arc connecting the sound image position RSP11 and the sound image position VSP11 on a circle having a radius of $r_s=r_t$.

In the example of FIG. 17, an angle between a straight line L21 connecting the user Ulf and the sound image position RSP11 and a straight line L22 connecting the user Ulf and the sound image position VSP11 can be the movement distance of the target sound image.

Specifically, if the sound image position RSP11 and the sound image position VSP11 have the same horizontal direction angle $\theta$, the target sound image is moved only in the vertical direction, and therefore, the difference $D_{move}$ calculated by the above formula (15) is the movement distance $D_{move}$ of the target sound image.

On the other hand, if the sound image position RSP11 and the sound image position VSP11 have different horizontal direction angles $\theta$, and the target sound image is moved in the horizontal direction as well, the difference $D_{move}$ calculated by the above formula (16) is the movement distance $D_{move}$ of the target sound image.

During the sound image localization control process, the movement determination unit 64 supplies not only the movement destination position of the target sound image and the mesh identification information, but also the movement distance $D_{move}$ of the target sound image obtained by calculating Formula (15) or Formula (16), to the gain calculation unit 22.

Also, the gain calculation unit 22 that has received the supply of the movement distance $D_{move}$ from the movement determination unit 64, calculates a gain $Gain_{move}$ for correcting the gain of each loudspeaker 12 (hereinafter also referred to as a movement distance correction gain), that depends on the movement distance $D_{move}$, using a broken line curve or a function curve, based on information supplied from a higher-level control device or the like.

For example, the broken line curve used in calculating the movement distance correction gain is represented by a number sequence including the values of movement distance correction gains corresponding to respective movement distances $D_{move}$.

Specifically, the number sequence of the values of movement distance correction gains $Gain_{move}$ [0, −1.5, −4.5, −6, −9, −10.5, −12, −13.5, −15, −15, −16.5, 16.5, −18, −18, −18, −19.5, −19.5, −21, −21, −21] (dB) is assumed to be information for obtaining movement distance correction gains.

In such a case, the value of the start point of the number sequence is a movement distance correction gain for the movement distance $D_{move}=0°$, and the value of the end point of the number sequence is a movement distance correction gain for the movement distance $D_{move}=180°$. Also, the value of a k-th point of the number sequence is a movement distance correction gain for the movement distance $D_{move}$ represented by the following formula (17).

[Math 17]

$$D_{move}=(k-1)\times\frac{180°}{\text{lenght_of_Curve}-1} \tag{17}$$

Note that, in Formula (17), length_of_Curve represents the length of the number sequence, i.e., the number of points included in the number sequence.

Also, it is assumed that the movement distance correction gain between adjacent points in the number sequence changes linearly, depending on the movement distance $D_{move}$. A broken line curve obtained by such a number sequence is a curve representing mapping between movement distance correction gains and movement distances $D_{move}$.

Figure 18:
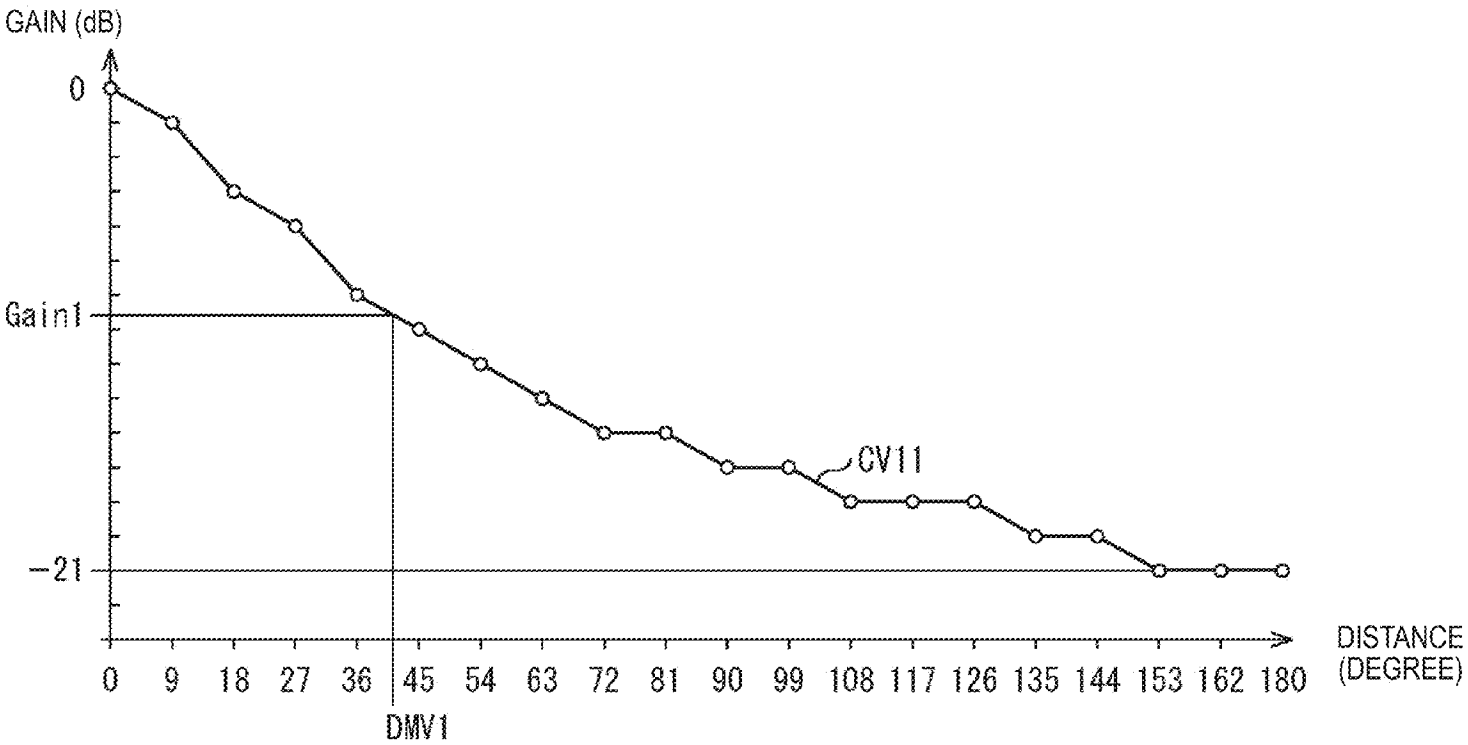
FIG. 18 is a diagram for describing a broken line curve.

For example, a broken line curve shown in FIG. 18 is obtained by the above number sequence.

In FIG. 18, the vertical axis indicates the values of movement distance correction gains, and the horizontal axis indicates movement distances $D_{move}$. Also, a broken line CV11 indicates a broken line curve, and a circle on the broken line curve indicates one numerical value included in the number sequence of the values of movement distance correction gains.

In this example, when the movement distance $D_{move}$ is DMV1, the movement distance correction gain is Gain1 that is the value of a gain at DMV1 on the broken line curve.

On the other hand, the function curve used in calculating movement distance correction gains is represented by three coefficients coef1, coef2, and coef3, and a gain value MinGain that is a predetermined lower limit.

In this case, the gain calculation unit 22 calculates the following formula (19) to obtain a movement distance correction gain $Gain_{move}$, using a function $f(D_{move})$ shown in the following formula (18) represented by the coefficient coef1 to the coefficient coef3, the gain value MinGain, and the movement distance $D_{move}$.

[Math 18] (18)

$$f(D_{move}) = MinGain \times \left(Coef1 \times \left(\frac{D_{move}}{180°}\right)^3 + Coef2 \times \left(\frac{D_{move}}{180°}\right)^2 + Coef3 \times \left(\frac{D_{move}}{180°}\right)\right)$$

[Math 19] (19)

$$Gain_{move} = \begin{cases} OdB, & f(D_{move}) > OdB \\ f(D_{move}), & \text{otherwise} \\ MinGain, & D_{move} > \text{Cut_Thre} \end{cases}$$

Note that, in Formula (19), Cut_Thre is a minimum value of the movement distance $D_{move}$ satisfying the following formula (20).

[Math 20]

$$f(D_{move})=\text{MinGain}, f(D_{move})<0 \quad (20)$$

Figure 19:
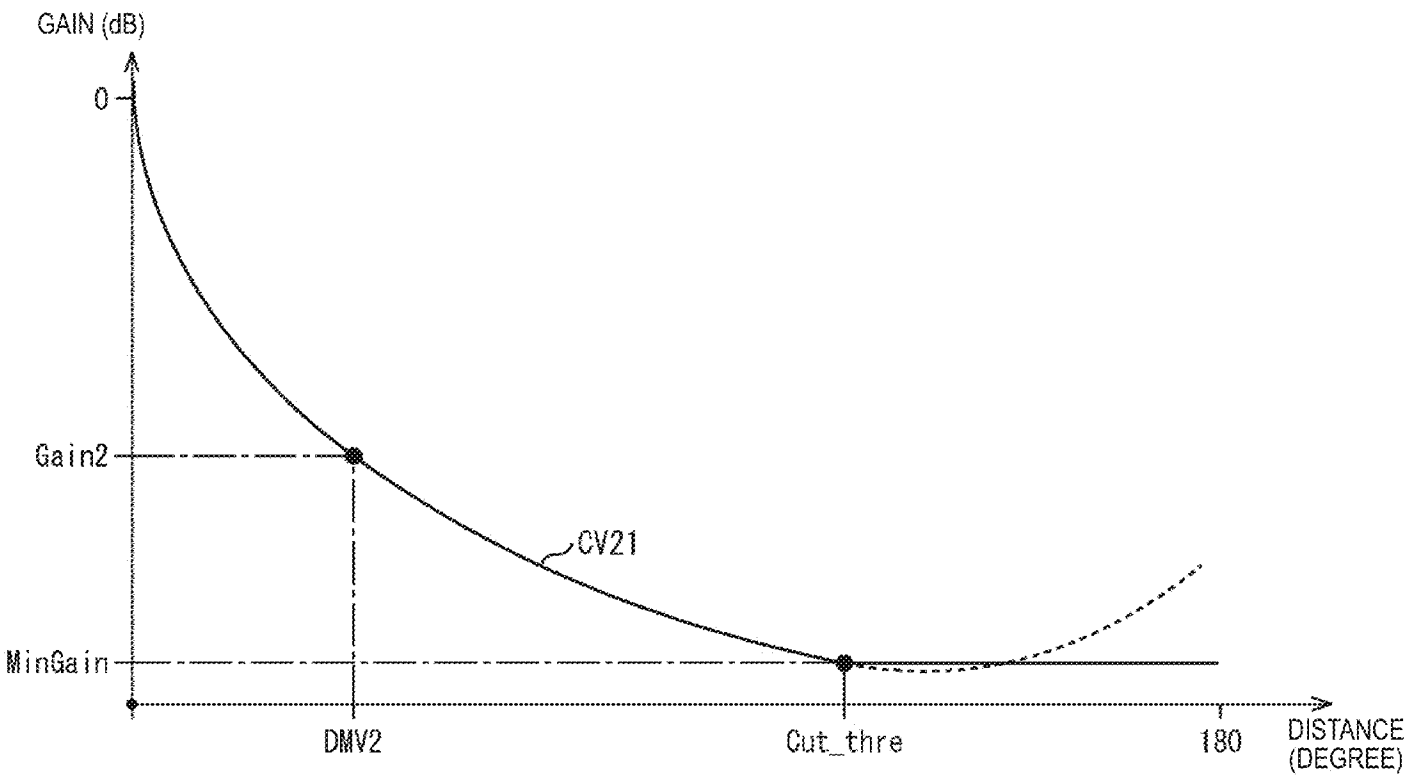
FIG. 19 is a diagram for describing a function curve.

A function curve represented by such a function $f(D_{move})$ or the like provides a curve shown in, for example, FIG. 19. Note that, in FIG. 19, the vertical axis represents the values of movement distance correction gains, and the horizontal axis represents movement distances $D_{move}$. Also, a curve CV21 represents a function curve.

In the function curve shown in FIG. 19, when the value of the movement distance correction gain represented by the function $f(D_{move})$ becomes smaller than the gain value MinGain as a lower limit for the first time, the values of movement distance correction gains at movement distances $D_{move}$ larger than that movement distance $D_{move}$ are assumed to be the gain value MinGain. Specifically, the values of movement distance correction gains at movement distances $D_{move}$ larger than the movement distance $D_{move}$=Cut_Thre are assumed to be the gain value MinGain. Note that a dotted line in the drawing indicates the values of the original function $f(D_{move})$ at movement distances $D_{move}$.

In this example, when the movement distance $D_{move}$ is DMV2, the movement distance correction gain $Gain_{move}$ is Gain2 that is the value of a gain on the function curve at DMV2.

Note that when a movement distance correction gain is obtained from a function curve, the combination of the coefficient coef1 to the coefficient coef3, i.e., [coef1, coef2, coef3], is, for example, [8, −12, 6], [1, −3, 3], [2, −5.3, 4.2], or the like.

Thus, the gain calculation unit 22 calculates the movement distance correction gain $Gain_{move}$ depending on the movement distance $D_{move}$ using either a broken line curve or a function curve.

Also, the gain calculation unit 22 calculates a correction gain $Gain_{corr}$ that is obtained by further correcting (adjusting) the movement distance correction gain $Gain_{move}$, depending on a distance to the user (viewer/listener).

The correction gain $Gain_{corr}$ is a gain for correcting the gain (coefficient) of each loudspeaker 12, depending on the movement distance $D_{move}$ of the target sound image, and the distance $r_s$ from the target sound image before movement to the user (viewer/listener).

For example, when VBAP is performed, the distance r is always one. When the distance r differs between before and after movement of the target sound image, such as when other panning-based techniques are employed, when the actual environment is not an ideal VBAP environment, or the like, the correction is performed based on the difference between the distances r. Specifically, because the distance $r_t$ from the position of the destination of the target sound image to the user is always assumed to be one, the correction is performed when the distance $r_s$ from the position of the target sound image before movement to the user is not one. Specifically, the gain calculation unit 22 performs the correction using the correction gain $Gain_{corr}$ and a delay process.

Here, the correction gain $Gain_{corr}$, and calculation of a delay amount Delay during the delay process, will be described.

Initially, the gain calculation unit 22 calculates a viewing/listening distance correction gain $Gain_{dist}$ for correcting the gain of each loudspeaker 12, depending on a difference between the distance $r_s$ and the distance $r_t$, using the following formula (21).

[Math 21] (21)

$$Gain_{dist} = -10 \times \log_{10}\left[\left(\frac{r_t}{r_s}\right)^2\right](\text{dB})$$

Moreover, the gain calculation unit 22 calculates the following formula (22) using the viewing/listening distance correction gain $Gain_{dist}$ thus calculated, and the above movement distance correction gain $Gain_{move}$, to obtain the correction gain $Gain_{corr}$.

[Math 22]

$$Gain_{corr}=Gain_{move}+Gain_{dist}\ (\text{dB}) \quad (22)$$

In Formula (22), the sum of the viewing/listening distance correction gain $Gain_{dist}$ and the movement distance correction gain $Gain_{move}$ is the correction gain $Gain_{corr}$.

Also, the gain calculation unit 22 calculates the following formula (23) using the distance $r_s$ of the target sound image before movement and the distance $r_t$ of the target sound image after movement, to obtain the delay amount Delay of a sound signal.

[Math 23]

$$\text{Delay}=(r_t-r_s)\times\text{sound speed } (s) \quad (23)$$

Thereafter, the gain calculation unit 22 delays or advances a sound signal by the delay amount Delay, and performs gain adjustment on the sound signal by correcting the gain (coefficient) of each loudspeaker 12 based on the correction gain $\text{Gain}_{corr}$. As a result, the volume adjustment and the delay process allows for a reduction in unrealistic sensation during sound reproduction due to movement of the target sound image or a difference in the distance r.

Figure 10:
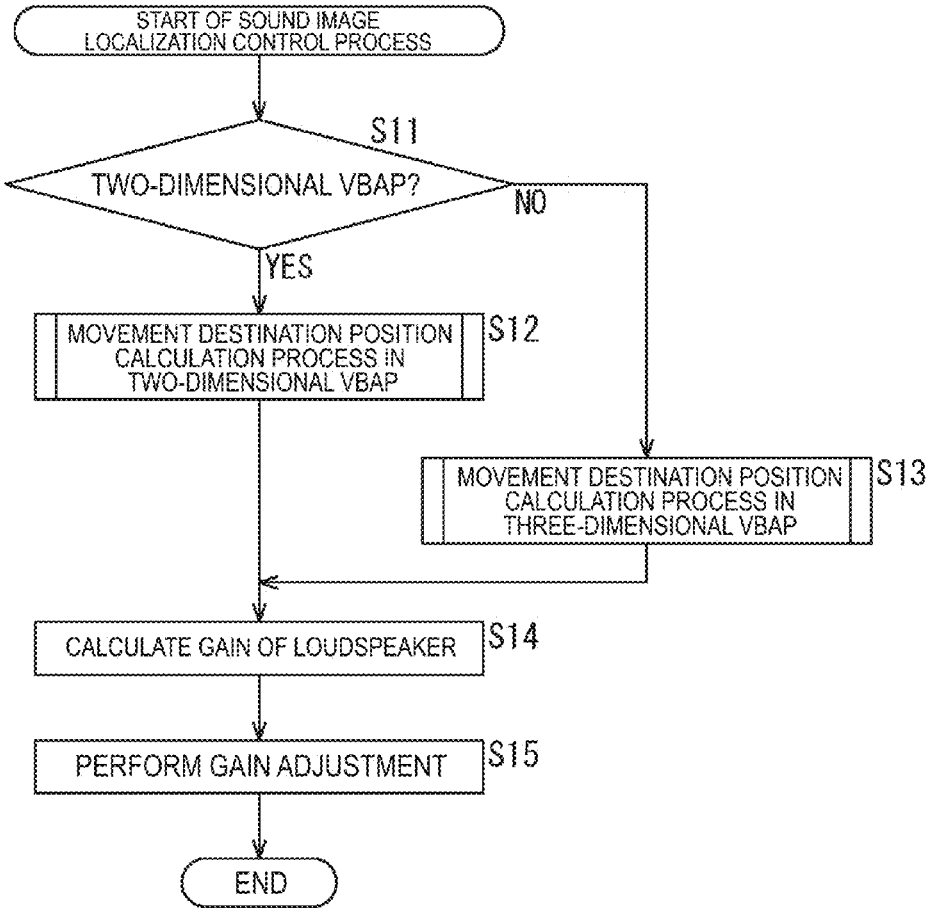
FIG. 10 is a flowchart for describing a sound image localization control process.
Figure 11:
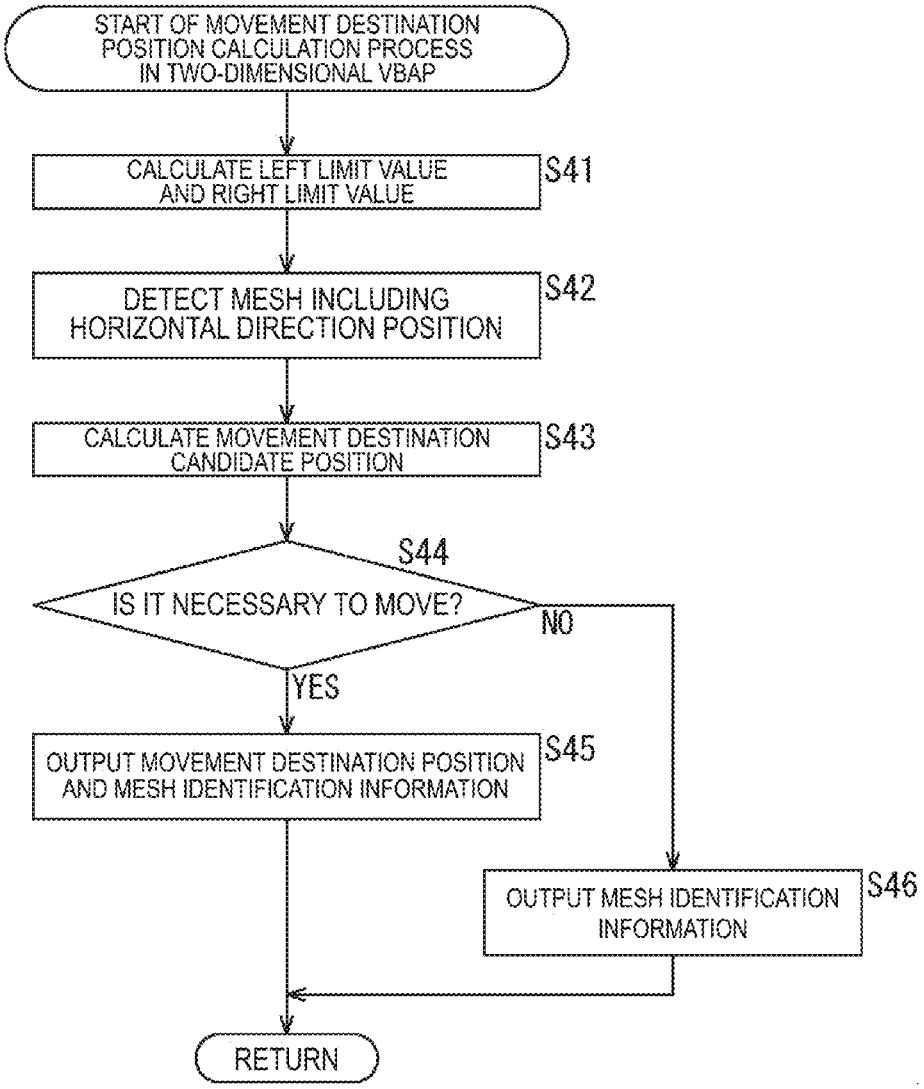
FIG. 11 is a flowchart for describing a movement destination position calculation process in two-dimensional VBAP.

Here, the gain (coefficient) calculated in the process of step S14 of FIG. 10, which is represented by a gain $\text{Gain}_{spk}$, is corrected by the correction gain $\text{Gain}_{corr}$ by calculation of the following formula (24), so that an adaptive gain $\text{Gain}_{spk_corr}$ that is a final gain (coefficient) is obtained.

[Math 24]

$$\text{Gain}_{spk_corr}=\text{Gain}_{spk}+\text{Gain}_{corr}\ (\text{dB}) \quad (24)$$

In Formula (24), the gain $\text{Gain}_{spk}$ is the gain (coefficient) of each loudspeaker 12 obtained by calculation of Formula (1) or Formula (3) in step S14 of FIG. 10.

The gain calculation unit 22 supplies the adaptive gain $\text{Gain}_{spk_corr}$ obtained by calculation of Formula (24) to the amplification unit 31, which then multiplies a sound signal of the loudspeaker 12 by the adaptive gain $\text{Gain}_{spk_corr}$.

Thus, if the gain of each loudspeaker 12 is corrected, depending on the movement distance $D_{move}$, the gain is reduced when the degree of movement of the target sound image is large, so that the user can feel as if the actual sound image position is at a position far away from a mesh. On the other hand, when the degree of movement of the target sound image is small, the gain of the target sound image is not substantially corrected, so that the user can feel as if the actual sound image position is at a position close to a mesh.

<Example Configuration of Sound Processing Device>

Next, a configuration and operation of the sound processing device in a case where the gain of each loudspeaker 12 is corrected, depending on the movement distance $D_{move}$, as described above, will be described.

Figure 20:
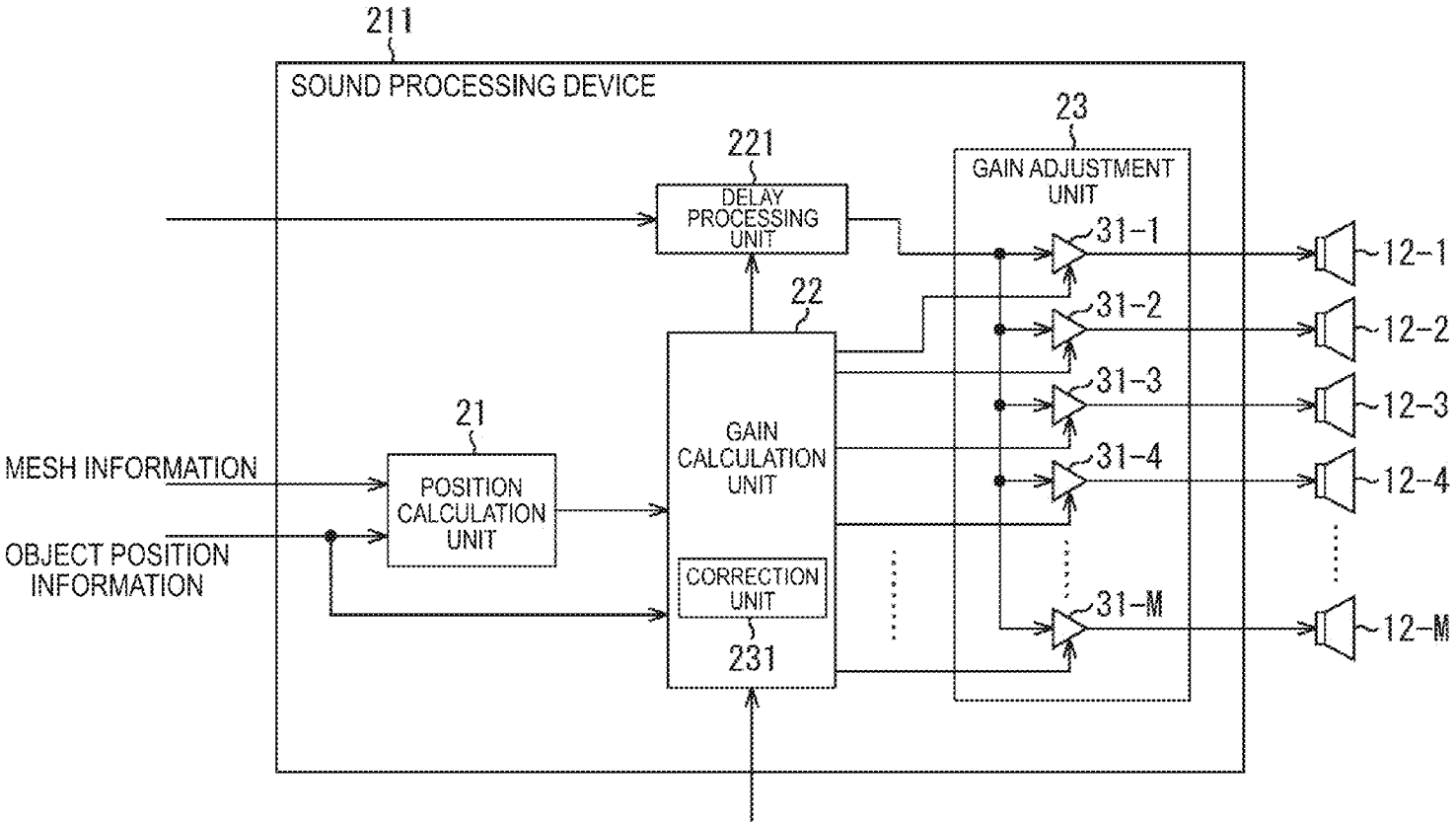
FIG. 20 is a diagram showing an example configuration of a sound processing device.

In such a case, the sound processing device is configured as shown in, for example, FIG. 20. Note that, in FIG. 20, parts corresponding to those in the case of FIG. 6 are indicated by the same reference characters, and will not be redundantly described.

A sound processing device 211 shown in FIG. 20 has a position calculation unit 21, a gain calculation unit 22, a gain adjustment unit 23, and a delay process unit 221. The sound processing device 211 has the same configuration as that of the sound processing device 11 of FIG. 6, except that the delay process unit 221 is provided, and a correction unit 231 is newly provided in the gain calculation unit 22. Note that, as described below, more specifically, the position calculation unit 21 of the sound processing device 211 has an internal configuration different from that of the position calculation unit 21 of the sound processing device 11.

In the sound processing device 211, the position calculation unit 21 calculates the movement destination position and movement distance $D_{move}$ of the target sound image, and supplies the movement destination position, the movement distance $D_{move}$, and the mesh identification information to the gain calculation unit 22.

The gain calculation unit 22 calculates the adaptive gain of each loudspeaker 12 based on the movement destination position, movement distance $D_{move}$, and mesh identification information supplied from the position calculation unit 21, and supplies the adaptive gain of each loudspeaker 12 to the amplification unit 31, and also calculates a delay amount and instructs the delay process unit 221 to perform delaying. Also, the gain calculation unit 22 includes a correction unit 231. The correction unit 231 calculates a correction gain $\text{Gain}_{corr}$ or an adaptive gain $\text{Gain}_{spk_corr}$ based on the movement distance $D_{move}$.

The delay process unit 221 performs a delay process on a sound signal supplied, in accordance with an instruction of the gain calculation unit 22, and supplies the sound signal to the amplification unit 31 at a timing determined by a delay amount.

<Configuration Example of Position Calculation Unit>

Figure 21:
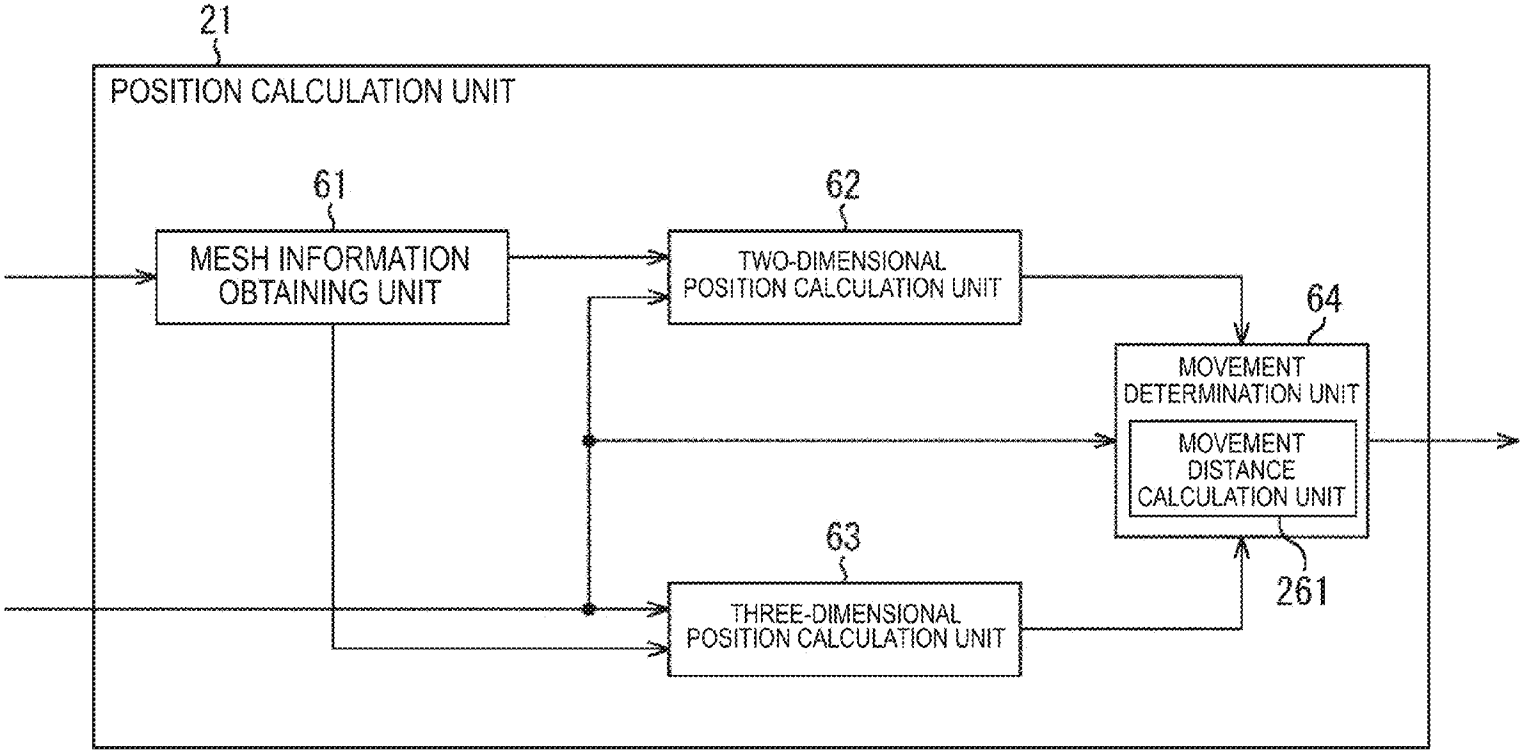
FIG. 21 is a diagram showing a configuration of a position calculation unit.

The position calculation unit 21 of the sound processing device 211 is configured as shown in, for example, FIG. 21. Note that, in FIG. 21, parts corresponding to those in the case of FIG. 7 are indicated by the same reference characters, and will not be redundantly described.

The position calculation unit 21 of FIG. 21 is the position calculation unit 21 shown in FIG. 7 that further includes a movement distance calculation unit 261 in the movement determination unit 64.

The movement distance calculation unit 261 calculates the movement distance $D_{move}$ based on the vertical direction angle or the like of the target sound image before movement, and the vertical direction angle or the like of the movement destination position of the target sound image.

<Description of Sound Image Localization Control Process>

Figure 22:
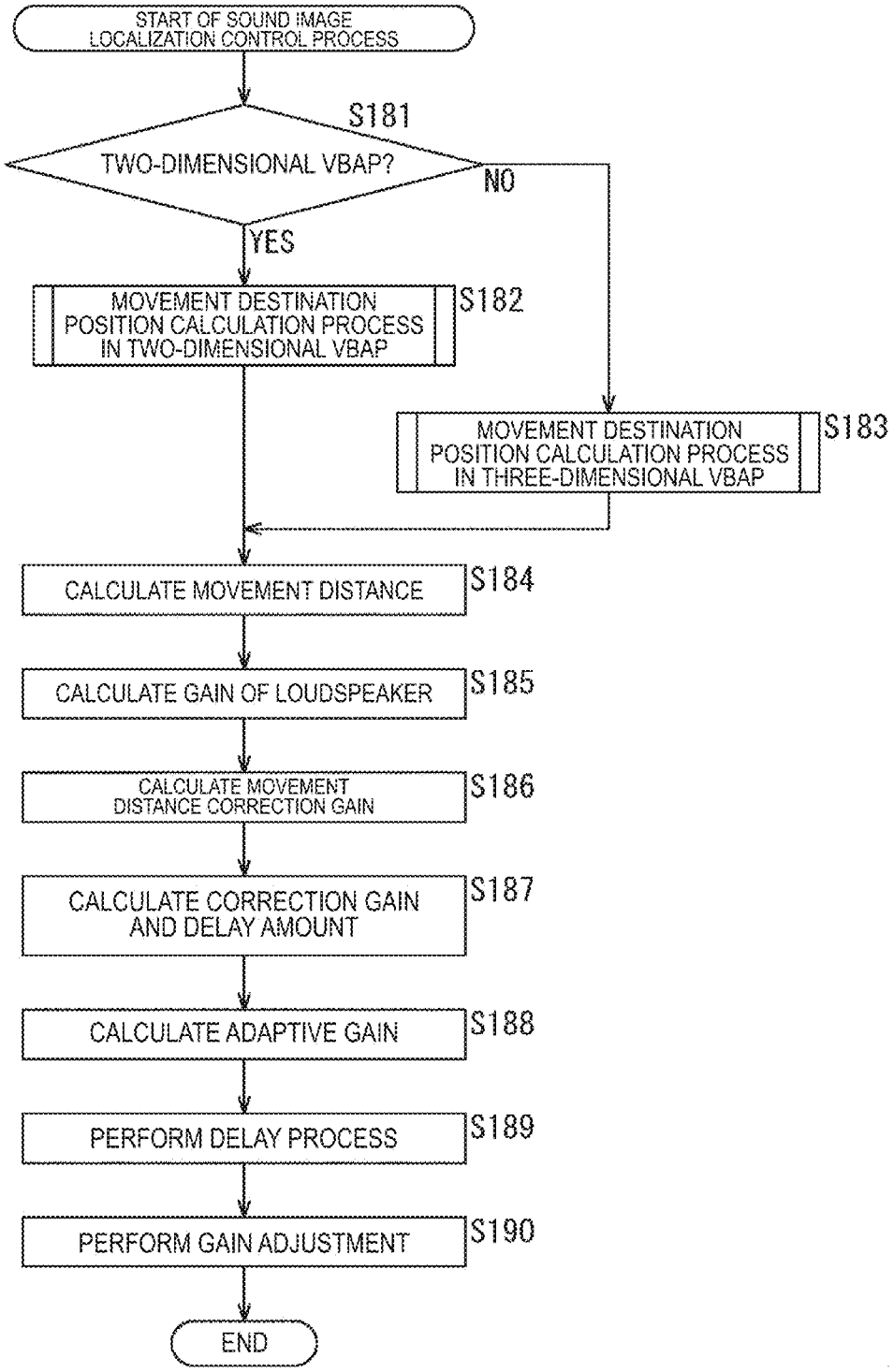
FIG. 22 is a flowchart for describing a sound image localization control process.

Next, the sound image localization control process performed by the sound processing device 211 will be described with reference to a flowchart of FIG. 22. Note that, processes of step S181 to step S183 are similar to those of step S11 to step S13 of FIG. 10, and therefore, will not be described.

In step S184, the movement distance calculation unit 261 calculates the above formula (15) based on the vertical direction angle $\gamma_{nD}$ of the movement destination position of the target sound image, and the original vertical direction angle 7 of the target sound image before movement, to obtain a movement distance $D_{move}$, and supplies the movement distance $D_{move}$ to the gain calculation unit 22.

Note that when the target sound image has been moved in the horizontal direction as well as in the vertical direction, the movement distance calculation unit 261 calculates the above formula (16) based on the vertical direction angle $\gamma_{nD}$ and horizontal direction angle $\theta_{nD}$ of the movement destination position of the target sound image, and the original vertical direction angle $\gamma$ and horizontal direction angle $\theta$ of the target sound image before movement, to obtain a movement distance $D_{move}$.

Also, a movement destination position and mesh identification information may be supplied to the gain calculation unit 22, simultaneously with the movement distance $D_{move}$.

In step S185, the gain calculation unit 22 calculates a gain $\text{Gain}_{spk}$ that is the gain of each loudspeaker 12, based on the movement destination position and identification information supplied from the position calculation unit 21, and object position information supplied. Note that, in step S185, a process similar to that of step S14 of FIG. 10.

In step S186, the correction unit 231 of the gain calculation unit 22 calculates a movement distance correction gain based on the movement distance $D_{move}$ supplied from the movement distance calculation unit 261.

For example, the correction unit 231 selects either a broken line curve or a function curve based on information supplied from a higher-level control device or the like.

When a broken line curve is selected, the correction unit 231 calculates a broken line curve based on a number sequence previously prepared, and obtains a movement distance correction gain $Gain_{move}$ corresponding to the movement distance $D_{move}$ from the broken line curve.

On the other hand, when a function curve is selected, the correction unit 231 calculates a function curve, i.e., values of the function shown in Formula (18), based on the previously prepared coefficient coef1 to coefficient coef3, gain value MinGain, and movement distance $D_{move}$, and performs the calculation of Formula (19) from the values to obtain a movement distance correction gain $Gain_{move}$.

In step S187, the correction unit 231 calculates a correction gain $Gain_{corr}$ and a delay amount Delay, based on the distance $r_t$ of the movement destination position of the target sound image, and the original distance $r_s$ of the target sound image before movement.

Specifically, the correction unit 231 calculates Formula (21) and Formula (22) based on the distance $r_t$ and the distance $r_s$, and the movement distance correction gain $Gain_{move}$, to obtain a correction gain $Gain_{corr}$. Also, the correction unit 231 calculates Formula (23) based on the distance $r_t$ and the distance $r_s$, to obtain a delay amount Delay. Although the distance $r_t$=1 in this example, the distance rt optionally has another value when the distance $r_t$ is not one.

In step S188, the correction unit 231 calculates Formula (24) based on the correction gain $Gain_{corr}$, and the gain $Gain_{spk}$ calculated in step S185, to obtain an adaptive gain $Gain_{spk_corr}$. Note that the adaptive gain $Gain_{spk_corr}$ of a loudspeaker(s) 12 other than the loudspeakers 12 that are at opposite ends of an arc of a mesh indicated by the identification information, on which the movement destination position of the target sound image is present, is assumed to be zero. Also, the above processes of step S184 to step S187 may be performed in any order.

After the adaptive gain $Gain_{spk_corr}$ is thus obtained, the gain calculation unit 22 supplies the calculated adaptive gain $Gain_{spk_corr}$ to each amplification unit 31, and also supplies the delay amount Delay to the delay process unit 221, and instructs the delay process unit 221 to perform a delay process on a sound signal.

In step S189, the delay process unit 221 performs a delay process on the supplied sound signal, based on the delay amount Delay supplied from the gain calculation unit 22.

Specifically, when the delay amount Delay has a positive value, the delay process unit 221 delays the supplied sound signal by a time indicated by the delay amount Delay, and supplies the sound signal to the amplification unit 31. Also, when the delay amount Delay has a negative value, the delay process unit 221 advances the output timing of the sound signal by a time indicated by the absolute value of the delay amount Delay, and supplies the sound signal to the amplification unit 31.

In step S190, the amplification unit 31 performs gain adjustment on the object sound signal supplied from the delay process unit 221, based on the adaptive gain $Gain_{spk_corr}$ supplied from the gain calculation unit 22, and supplies the resultant sound signal to the loudspeaker 12, which then outputs sound.

Each loudspeaker 12 outputs sound based on a sound signal supplied from the amplification unit 31. As a result, a sound image can be localized at a target position. When the loudspeakers 12 output sound, the sound image localization control process is ended.

Thus, the sound processing device 211 calculates the movement destination position of the target sound image, obtains the gain of each loudspeaker 12 corresponding to the calculation result, and also corrects the gain, depending on the movement distance of the target sound image or a distance to the user, and thereafter, performs gain adjustment on a sound signal. As a result, a target position can be appropriately adjusted by volume adjustment, and a sound image can be localized at the position after the correction. As a result, higher-quality sound can be obtained.

Thus, according to the sound processing device 211, when a sound image is reproduced at a position deviated from a place where the sound image is intended to be localized, the movement amount of the sound image can be expressed by adjusting the reproduction volume of a sound source, depending on the movement amount of the sound image position, and a deviation between the actual reproduction position of the sound image and the original position where the sound image is intended to be reproduced, due to the movement, can be reduced.

Incidentally, the present technology described above is applicable to the downmix technology, which converts the number of channels of an input signal and the arrangement of loudspeakers into a format in which the input signal can be reproduced using an actual number of channels and an actual loudspeaker arrangement, if the number of channels of the input signal and the arrangement of loudspeakers are different from the actual number of channels and the actual loudspeaker arrangement, in multi-channel audio reproduction.

A case where the present technology is applied to the downmix technology will now be described with reference to FIG. 23 to FIG. 25. Note that parts corresponding to those in the case of FIG. 23 to FIG. 25 are indicated by the same reference characters, and will not be redundantly described.

Figure 23:
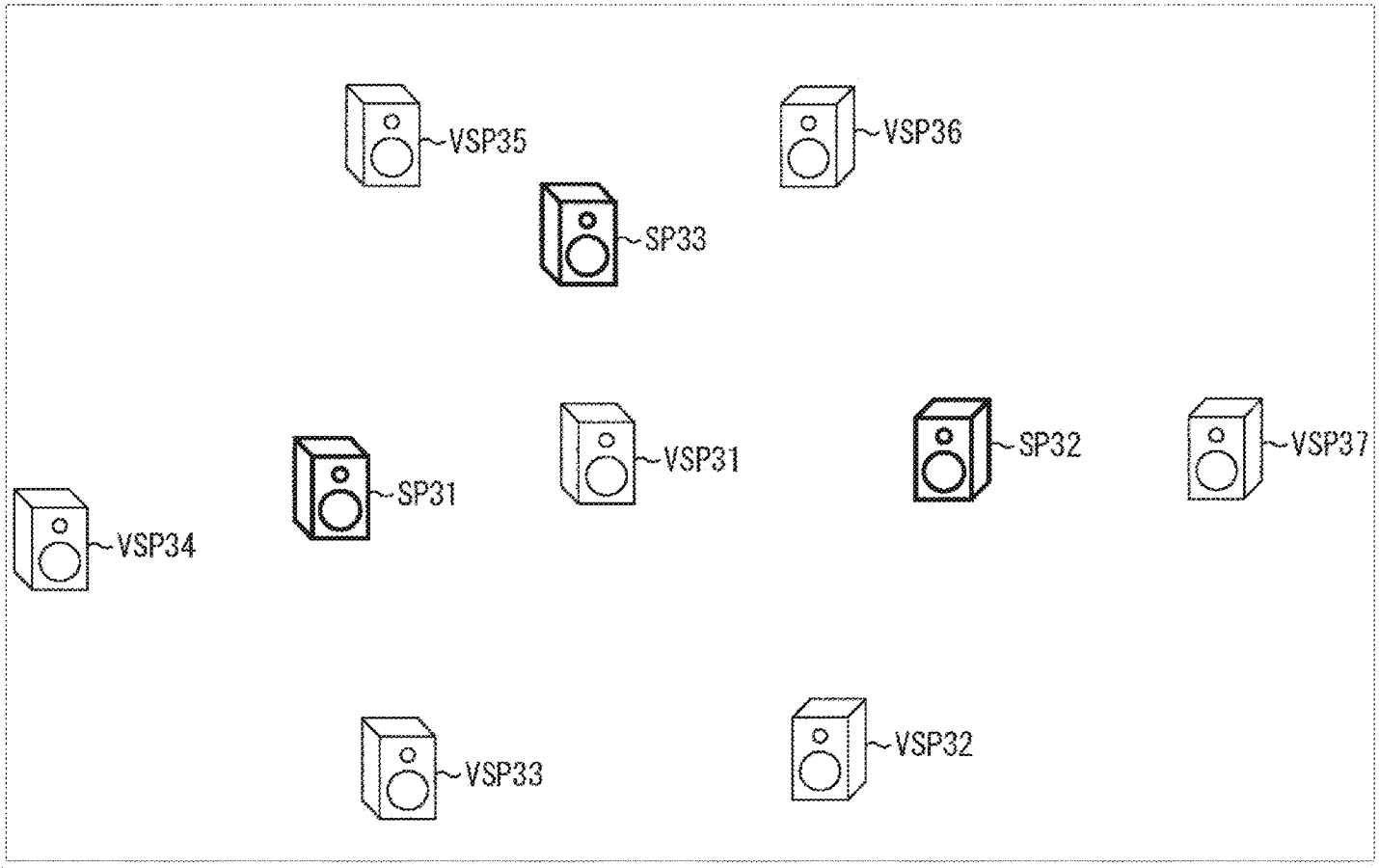
FIG. 23 is a diagram for describing an application of the present technology to the downmix technology.

For example, as shown in FIG. 23, a case will be discussed in which a sound signal that should be reproduced at each of the positions of seven virtual loudspeakers VSP31 to VSP37, is reproduced by three actual loudspeakers SP31 to SP33.

In this case, if the position of each of the virtual loudspeaker VSP31 to the virtual loudspeaker VSP37 is assumed to be the sound image position of a sound source, the sound source position can be reproduced by the three loudspeakers SP31 to SP33 actually existing, using the above VBAP.

Figure 24:
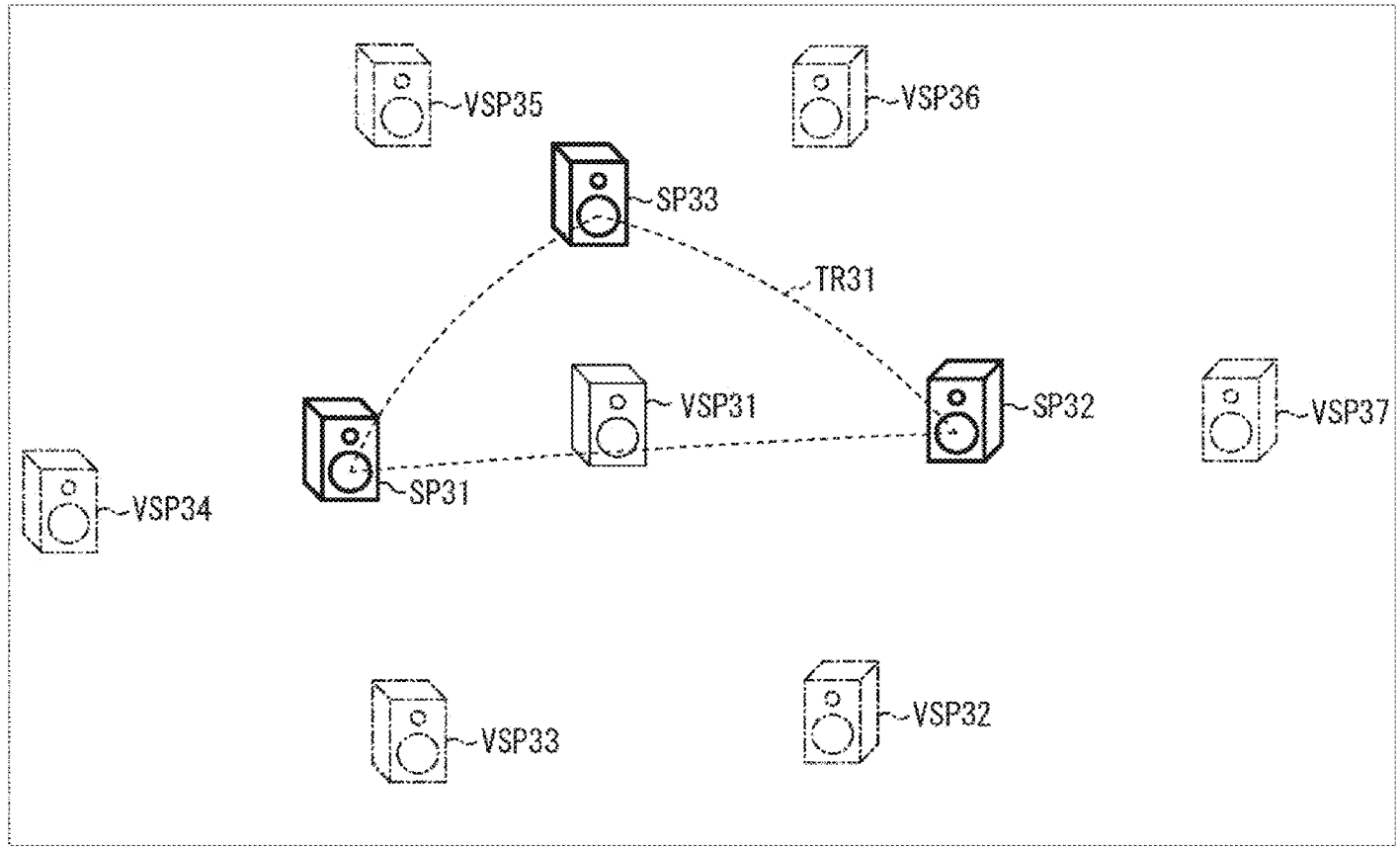
FIG. 24 is a diagram for describing an application of the present technology to the downmix technology.
Figure 25:
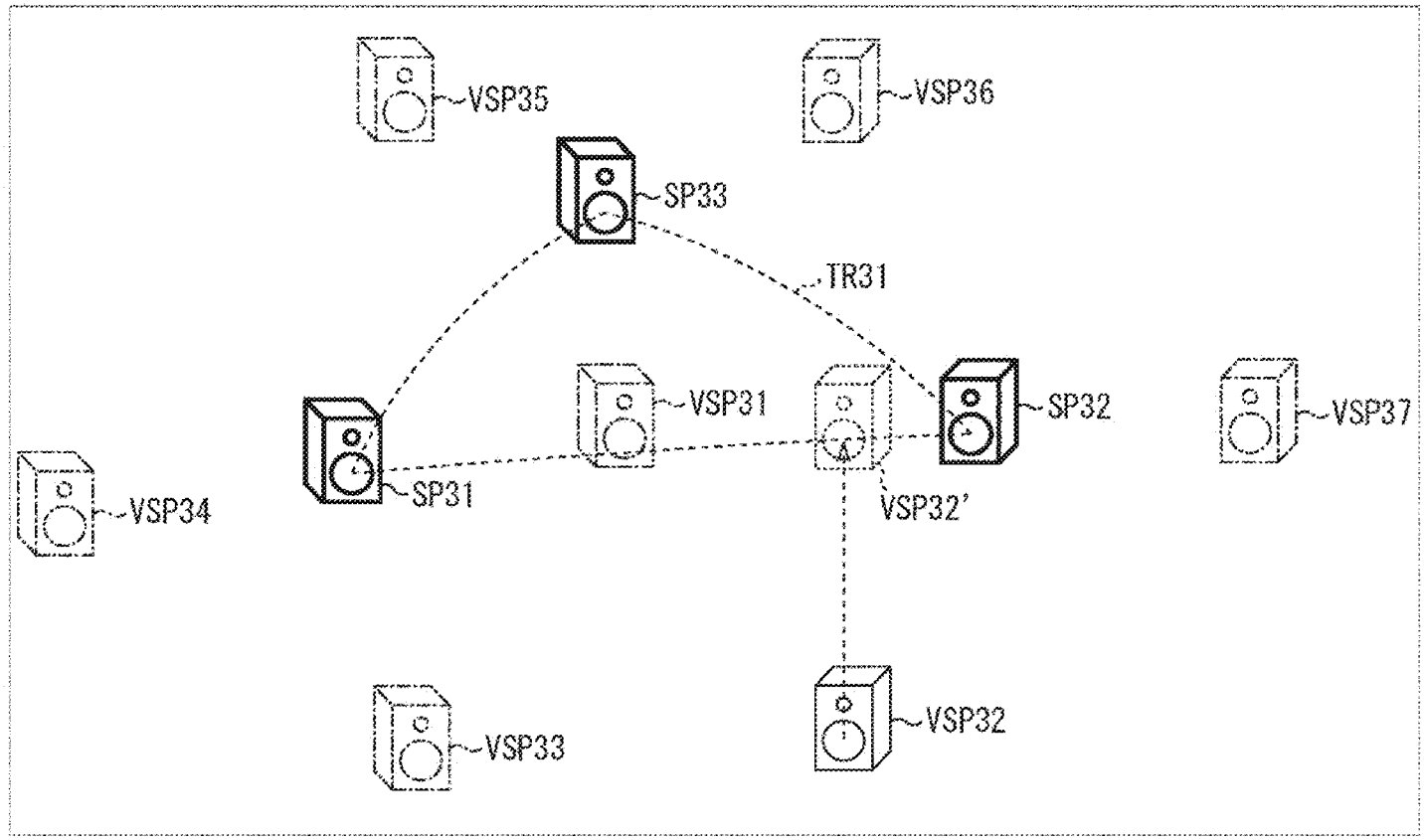
FIG. 25 is a diagram for describing an application of the present technology to the downmix technology.

However, in VBAP of the background art, as shown in FIG. 24, a sound source can be reproduced only at the position of the virtual loudspeaker VSP31 that is in a mesh TR31 surrounded by the three loudspeakers SP31 to SP33 actually existing.

Here, the mesh TR31 is a region surrounded by the loudspeaker SP31 to the loudspeaker SP33 in a spherical surface on which each loudspeaker is placed.

In VBAP of the background art, when sound is output from the loudspeaker SP31 to the loudspeaker SP33, no position outside the mesh TR31 can be the sound image position of a sound source, and therefore, only the position of the virtual loudspeaker VSP31 in the mesh TR31 can be the sound image position of the sound source.

On the other hand, as shown in, for example, FIG. 25, the present technology can be used to express, as the sound image position of a sound source, a range surrounded by the three loudspeakers SP31 to SP33 actually existing, i.e., a loudspeaker position outside the mesh TR31.

In this example, the sound image position of the virtual loudspeaker VSP32 outside the mesh TR31 may be moved using the above present technology to a position within the mesh TR31, i.e., a position on a boundary line of the mesh TR31. Specifically, if the present technology is used to move the sound image position of the virtual loudspeaker VSP32 that is outside the mesh TR31 to the sound image position of a virtual loudspeaker VSP32' that is within the mesh TR31, a sound image can be localized at the position of the virtual loudspeaker VSP32' by VBAP.

If, as with the virtual loudspeaker VSP32, the sound image positions of the other virtual loudspeaker VSP33 to virtual loudspeaker VSP37 that are outside the mesh TR31 are moved onto a boundary of the mesh TR31, their sound images can be localized by VBAP.

As a result, a sound signal that should be reproduced at the positions of the virtual loudspeaker VSP31 to the virtual loudspeaker VSP37 can be reproduced from the three loudspeakers SP31 to SP33 actually existing.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose personal computer or the like that is capable of executing various functions when various programs are installed.

Figure 26:
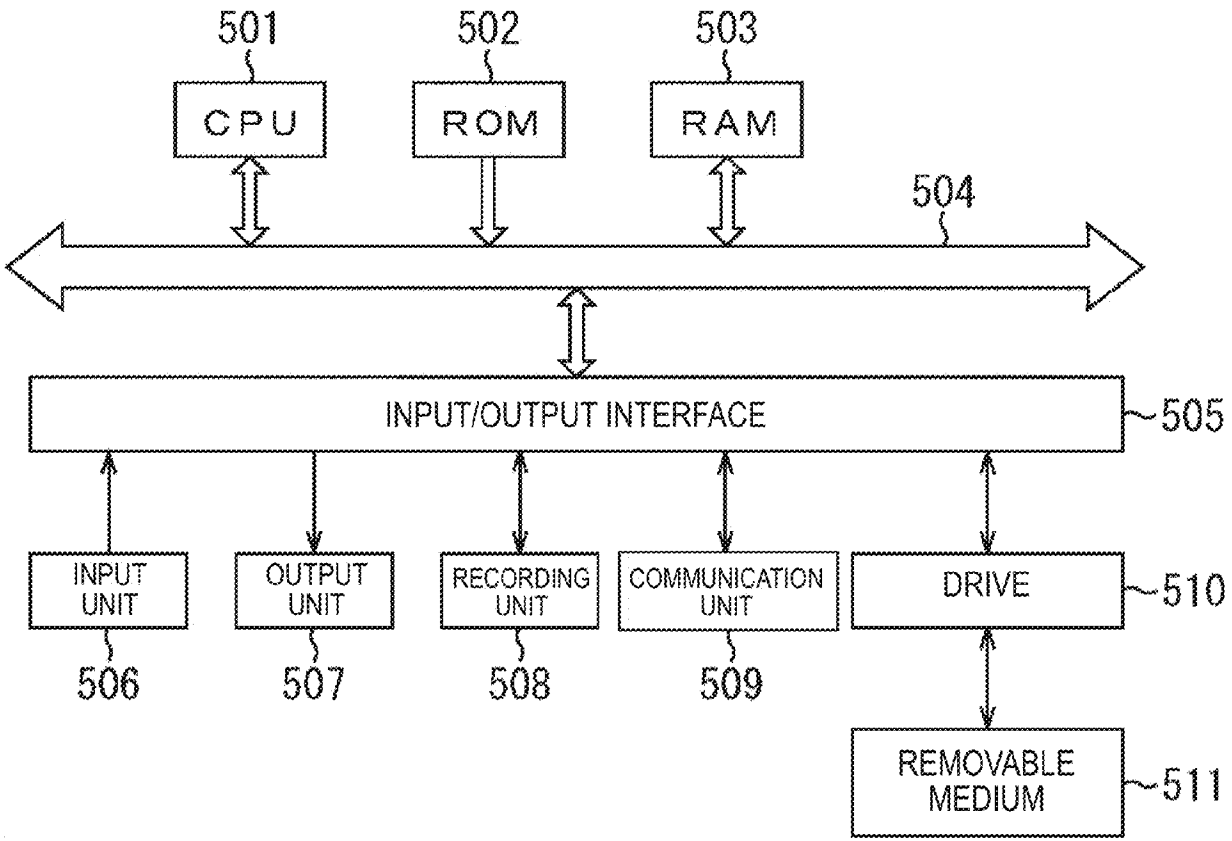
FIG. 26 is a diagram showing an example configuration of a computer.

FIG. 26 is a block diagram showing a hardware configuration example of a computer that performs the above-described series of processing using a program.

In such computer, a CPU (Central Processing Unit) 501, a ROM (Read Only Memory) 502, and a RAM (Random Access Memory) 503 are connected to one another by a bus 504.

An input/output interface 505 is also connected to the bus 504. An input unit 506, an output unit 507, a recording unit 508, a communication unit 509, and a drive 510 are connected to the input/output interface 505.

The input unit 506 is configured from a keyboard, a mouse, a microphone, an imaging device or the like. The output unit 507 is configured from a display, a speaker or the like. The recording unit 508 is configured from a hard disk, a non-volatile memory or the like. The communication unit 509 is configured from a network interface or the like. The drive 510 drives a removable medium 511 such as a magnetic disk, an optical disk, a magneto-optical disk, a semiconductor memory or the like.

In the computer configured as described above, as one example the CPU 501 loads a program recorded in the recording unit 508 via the input/output interface 505 and the bus 504 into the RAM 503 and executes the program to carry out the series of processes described earlier.

Programs to be executed by the computer (the CPU 501) are provided being recorded in the removable medium 511 which is a packaged medium or the like. Also, programs may be provided via a wired or wireless transmission medium, such as a local area network, the Internet or digital satellite broadcasting.

In the computer, by loading the removable recording medium 511 into the drive 510, the program can be installed into the recording unit 508 via the input/output interface 505. It is also possible to receive the program from a wired or wireless transfer medium using the communication unit 509 and install the program into the recording unit 508. As another alternative, the program can be installed in advance into the ROM 502 or the recording unit 508.

It should be noted that the program executed by a computer may be a program that is processed in time series according to the sequence described in this specification or a program that is processed in parallel or at necessary timing such as upon calling.

An embodiment of the disclosure is not limited to the embodiments described above, and various changes and modifications may be made without departing from the scope of the disclosure.

For example, the present disclosure can adopt a configuration of cloud computing which processes by allocating and connecting one function by a plurality of apparatuses through a network.

Further, each step described by the above mentioned flow charts can be executed by one apparatus or by allocating a plurality of apparatuses.

In addition, in the case where a plurality of processes is included in one step, the plurality of processes included in this one step can be executed by one apparatus or by allocating a plurality of apparatuses.

Additionally, the present technology may also be configured as below.

(1)

An information processing device including:

a detection unit configured to detect at least one mesh including a horizontal direction position of a target sound image in a horizontal direction, of meshes that are a region surrounded by a plurality of loudspeakers, and specify at least one mesh boundary that is a movement target of the target sound image in the mesh; and a calculation unit configured to calculate a movement position of the target sound image on the specified at least one mesh boundary that is the movement target, based on positions of two of the loudspeakers present on the specified at least one mesh boundary that is the movement target, and the horizontal direction position of the target sound image.

(2)

The information processing device according to (1), wherein the movement position is a position on the boundary having a same position as the horizontal direction position of the target sound image in the horizontal direction.

(3)

The information processing device according to (1) or (2), wherein the detection unit detects the mesh including the horizontal direction position of the target sound image in the horizontal direction, based on positions in the horizontal direction of the loudspeakers forming the mesh, and the horizontal direction position of the target sound image.

(4)

The information processing device according to any one of (1) to (3), further including:

a determination unit configured to determine whether or not it is necessary to move the target sound image, based on at least either of a position relationship between the loudspeakers forming the mesh, or positions in a vertical direction of the target sound image and the movement position.

(5)

The information processing device according to (4), further including:

a gain calculation unit configured to, when it is determined that it is necessary to move the target sound image, calculate a gain of a sound signal of sound, based on the movement position, and positions of the loudspeakers of the mesh, in a manner that a sound image of the sound is to be localized at the movement position.

(6)

The information processing device according to (5), wherein the gain calculation unit adjusts the gain based on a difference between a position of the target sound image and the movement position.

(7)

The information processing device according to (6), wherein the gain calculation unit further adjusts the gain based on a distance from the position of the target sound image to a user, and a distance from the movement position to the user.

(8)

The information processing device according to (4), further including:

a gain calculation unit configured to, when it is determined that it is not necessary to move the target sound image, calculate a gain of a sound signal of sound, based on a position of the target sound image and positions of the loudspeakers of the mesh, in a manner that a sound image of the sound is to be localized at the position of the target sound image, the mesh including the horizontal direction position of the target sound image in the horizontal direction.

(9)

The information processing device according to any one of (4) to (8), wherein the determination unit determines that it is necessary to move the target sound image, when a highest position in the vertical direction of the movement positions calculated for the meshes is lower than a position of the target sound image.

(10)

The information processing device according to any one of (4) to (9), wherein the determination unit determines that it is necessary to move the target sound image, when a lowest position in the vertical direction of the movement positions calculated for the meshes is higher than a position of the target sound image.

(11)

The information processing device according to any one of (4) to (10), wherein the determination unit determines that it is not necessary to move the target sound image downward, when the loudspeaker is present at a highest possible position in the vertical direction.

(12)

The information processing device according to any one of (4) to (11), wherein the determination unit determines that it is not necessary to move the target sound image upward, when the loudspeaker is present at a lowest possible position in the vertical direction.

(13)

The information processing device according to any one of (4) to (12), wherein the determination unit determines that it is not necessary to move the target sound image downward, when there is the mesh including a highest possible position in the vertical direction.

(14)

The information processing device according to any one of (4) to (13), wherein the determination unit determines that it is not necessary to move the target sound image upward, when there is the mesh including a lowest possible position in the vertical direction.

(15)

The information processing device according to any one of (1) to (3), wherein the calculation unit calculates and records a maximum value and a minimum value of the movement position for each of the horizontal direction positions in advance, and wherein the information processing device further comprises a determination unit configured to calculate a final version of the movement position of the target sound image based on the recorded maximum value and minimum value of the movement position, and a position of the target sound image.

(16)

An information processing method including the steps of:

detecting at least one mesh including a horizontal direction position of a target sound image in a horizontal direction, of meshes that are a region surrounded by a plurality of loudspeakers, and specifying at least one mesh boundary that is a movement target of the target sound image in the mesh; and calculating a movement position of the target sound image on the specified at least one mesh boundary that is the movement target, based on positions of two of the loudspeakers present on the specified at least one mesh boundary that is the movement target, and the horizontal direction position of the target sound image.

(17)

A program causing a computer to execute a process including the steps of:

detecting at least one mesh including a horizontal direction position of a target sound image in a horizontal direction, of meshes that are a region surrounded by a plurality of loudspeakers, and specifying at least one mesh boundary that is a movement target of the target sound image in the mesh; and calculating a movement position of the target sound image on the specified at least one mesh boundary that is the movement target, based on positions of two of the loudspeakers present on the specified at least one mesh boundary that is the movement target, and the horizontal direction position of the target sound image.

REFERENCE SIGNS LIST

11 sound processing device
12-1 to 12-M, 12 loudspeaker
21 position calculation unit
22 gain calculation unit
62 two-dimensional position calculation unit
63 three-dimensional position calculation unit
64 movement determination unit
91 end calculation unit
92 mesh detection unit
93 candidate position calculation unit
131 determination unit
132 end calculation unit
133 mesh detection unit
134 candidate position calculation unit
135 end calculation unit
136 mesh detection unit
137 candidate position calculation unit
182 memory

The invention claimed is:

1. An information processing device comprising:

circuitry including a processing device and a memory encoded with instructions that, when executed by the processing device, implement:

a detection unit configured to detect at least one mesh including a horizontal direction position of a target sound image in a horizontal direction, of meshes that are a region surrounded by a plurality of loudspeakers, and specify at least one mesh boundary that is a movement target of the target sound image in the mesh;

a calculation unit configured to calculate a movement position of the target sound image on the specified at least one mesh boundary that is the movement target, based on positions of two of the loudspeakers present on the specified at least one mesh boundary that is the movement target, and the horizontal direction position of the target sound image, wherein the target sound image is outside all of the meshes and wherein the horizontal direction position of the target sound image is fixed and the target sound image is moved only in a vertical direction from a vertical direction position of the target sound image to the calculated movement position on the specified at least one mesh boundary that is the movement target in response to calculating the movement position of the target sound image on the specified at least one mesh boundary; and a gain adjustment unit configured to adjust a sound signal and to output adjusted sound signals to respective ones of the plurality of loudspeakers based on the calculated movement position of the target sound image.

2. The information processing device according to claim 1, wherein the movement position is a position on the boundary having a same position as the horizontal direction position of the target sound image in the horizontal direction.

3. The information processing device according to claim 2, wherein the detection unit detects the mesh including the horizontal direction position of the target sound image in the horizontal direction, based on positions in the horizontal direction of the loudspeakers forming the mesh, and the horizontal direction position of the target sound image.

4. The information processing device according to claim 2, wherein the calculation unit calculates and records a maximum value and a minimum value of the movement position for each of the horizontal direction positions in advance, and wherein the information processing device further comprises a determination unit configured to calculate a final version of the movement position of the target sound image based on the recorded maximum value and minimum value of the movement position, and a position of the target sound image.

5. The information processing device according to claim 2, wherein the instructions further implement:

a determination unit configured to determine whether or not it is necessary to move the target sound image, based on at least either of a position relationship between the loudspeakers forming the mesh, or positions in a vertical direction of the target sound image and the movement position.

6. The information processing device according to claim 5, wherein the instructions further implement:

a gain calculation unit configured to, when it is determined that it is necessary to move the target sound image, calculate a gain of a sound signal of sound, based on the movement position, and positions of the loudspeakers of the mesh, in a manner that a sound image of the sound is to be localized at the movement position.

7. The information processing device according to claim 6, wherein the gain calculation unit adjusts the gain based on a difference between a position of the target sound image and the movement position.

8. The information processing device according to claim 7, wherein the gain calculation unit further adjusts the gain based on a distance from the position of the target sound image to a user, and a distance from the movement position to the user.

9. The information processing device according to claim 5, wherein the instructions further implement:

a gain calculation unit configured to, when it is determined that it is not necessary to move the target sound image, calculate a gain of a sound signal of sound, based on a position of the target sound image and positions of the loudspeakers of the mesh, in a manner that a sound image of the sound is to be localized at the position of the target sound image, the mesh including the horizontal direction position of the target sound image in the horizontal direction.

10. The information processing device according to claim 5, wherein the determination unit determines that it is necessary to move the target sound image, when a highest position in the vertical direction of the movement positions calculated for the meshes is lower than a position of the target sound image.

11. The information processing device according to claim 5, wherein the determination unit determines that it is necessary to move the target sound image, when a lowest position in the vertical direction of the movement positions calculated for the meshes is higher than a position of the target sound image.

12. The information processing device according to claim 5, wherein the determination unit determines that it is not necessary to move the target sound image downward, when the loudspeaker is present at a highest possible position in the vertical direction.

13. The information processing device according to claim 5, wherein the determination unit determines that it is not necessary to move the target sound image upward, when the loudspeaker is present at a lowest possible position in the vertical direction.

14. The information processing device according to claim 5, wherein the determination unit determines that it is not necessary to move the target sound image downward, when there is the mesh including a highest possible position in the vertical direction.

15. The information processing device according to claim 5, wherein the determination unit determines that it is not necessary to move the target sound image upward, when there is the mesh including a lowest possible position in the vertical direction.

16. An information processing method comprising:

detecting at least one mesh including a horizontal direction position of a target sound image in a horizontal direction, of meshes that are a region surrounded by a plurality of loudspeakers, and specifying at least one mesh boundary that is a movement target of the target sound image in the mesh;

calculating a movement position of the target sound image on the specified at least one mesh boundary that is the movement target, based on positions of two of the loudspeakers present on the specified at least one mesh boundary that is the movement target, and the horizontal direction position of the target sound image, wherein the target sound image is outside all of the meshes and wherein the horizontal direction position of the target sound image is fixed and the target sound image is moved only in a vertical direction from a vertical direction position of the target sound image to the calculated movement position on the specified at least one mesh boundary that is the movement target in response to calculating the movement position of the target sound image on the specified at least one mesh boundary; and adjusting a sound signal and outputting adjusted sound signals to respective ones of the plurality of loudspeakers based on the calculated movement position of the target sound image.

17. A non-transitory computer readable storage device encoded with computer executable instructions that, when executed by a processing device, perform a process comprising:

detecting at least one mesh including a horizontal direction position of a target sound image in a horizontal direction, of meshes that are a region surrounded by a plurality of loudspeakers, and specifying at least one mesh boundary that is a movement target of the target sound image in the mesh;

calculating a movement position of the target sound image on the specified at least one mesh boundary that is the movement target, based on positions of two of the loudspeakers present on the specified at least one mesh boundary that is the movement target, and the horizontal direction position of the target sound image, wherein the target sound image is outside all of the meshes and wherein the horizontal direction position of the target sound image is fixed and the target sound image is moved only in a vertical direction from a vertical direction position of the target sound image to the calculated movement position on the specified at least one mesh boundary that is the movement target in response to calculating the movement position of the target sound image on the specified at least one mesh boundary; and adjusting a sound signal and outputting adjusted sound signals to respective ones of the plurality of loudspeakers based on the calculated movement position of the target sound image.

* * * * *